US006706468B2

(12) United States Patent
Aiba et al.

(10) Patent No.: US 6,706,468 B2
(45) Date of Patent: Mar. 16, 2004

(54) SILVER HALIDE PHOTOGRAPHIC EMULSION AND SILVER HALIDE COLOR PHOTOGRAPHIC MATERIAL USING THE SAME

(75) Inventors: Satoshi Aiba, Kanagawa (JP); Osamu Yonekura, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 33 days.

(21) Appl. No.: 09/962,079

(22) Filed: Sep. 26, 2001

(65) Prior Publication Data

US 2002/0068248 A1 Jun. 6, 2002

(30) Foreign Application Priority Data

Sep. 28, 2000 (JP) ..... P.2000-297214

(51) Int. Cl.[7] ..... G03C 1/005; G03C 1/494

(52) U.S. Cl. ..... 430/567; 430/502; 430/569; 430/570; 430/576; 430/604; 430/605

(58) Field of Search ..... 430/567, 569, 430/502, 570, 576, 604, 605

(56) References Cited

U.S. PATENT DOCUMENTS

| | | | | |
|---|---|---|---|---|
| 5,156,946 A | * | 10/1992 | Nagaoka et al. | 430/567 |
| 5,985,534 A | * | 11/1999 | Maruyama | 430/567 |
| 6,194,134 B1 | * | 2/2001 | Matsunaga et al. | 430/567 |
| 6,248,507 B1 | | 6/2001 | Budz et al. | 430/363 |

FOREIGN PATENT DOCUMENTS

EP 0 718 679 A1 12/1995

* cited by examiner

*Primary Examiner*—Geraldine Letscher
(74) *Attorney, Agent, or Firm*—Sughrue Mion, PLLC

(57) ABSTRACT

A silver halide photographic emulsion is disclosed, comprising silver chloroiodide grains or silver chloroiodobromide grains, having 90 mol % or more of a silver chloride content, wherein the silver chloroiodide grains or silver chloroiodobromide grains have a layer having a silver iodide content of decreasing in the depth direction from the grain surface.

11 Claims, 7 Drawing Sheets

SILVER HALIDE PHOTOGRAPHIC EMULSION AND SILVER HALIDE COLOR PHOTOGRAPHIC MATERIAL USING THE SAME

FIELD OF THE INVENTION

The present invention relates to a silver halide emulsion which is low in generation of fog notwithstanding high sensitivity, excellent in a reciprocity law characteristic at high intensity illuminance, and low in fluctuations in sensitivity and gradation due to the time variation after exposure until processing, and also relates to a producing method of the same and a silver halide color photographic material containing the same.

BACKGROUND OF THE INVENTION

In the field of color photographic paper, demands for performances such as higher sensitization, stabilization of processing, the improvement of image quality and the improvement of development processing speed have been remarkably increased in recent years. In higher sensitization of a silver chloride emulsion, the incorporation of a bromide ion into the emulsion grain has been primarily discussed. For example, a method of incorporating a bromide ion into the surface of a grain is disclosed in EP 0295439, a method of incorporating an epitaxially formed local phase having a bromide concentration of at least 20 mol % into the grain surface is disclosed in U.S. Pat. No. 5,252,454, and a method of blending a fine grain emulsion with a high silver chloride host grain emulsion having larger grain size and performing Ostwald ripening to thereby form a bromide rich phase on the surface of a grain is disclosed in U.S. Pat. No. 5,252,456. On the other hand, sensitivity is also increased by incorporating an iodide ion into a silver chloride emulsion grain. However, the examples of using iodide ions for the purpose of higher sensitization are not so many hitherto and, as represented by the above-cited patents, iodide ion is in general permitted only in low concentration or avoided.

Some examples of achieving higher sensitization by the incorporation of an iodide ion in a high silver chloride emulsion are shown below. Techniques of forming a high silver chloride {100} tabular grain and then incorporating an iodide ion into the grain in the state of a band are disclosed in U.S. Pat. Nos. 5,264,337, 5,292,632 and 5,314,798. An example of epitaxially adhering a bromide ion and a low iodide content ion in combination on the corners of a tabular grain is disclosed in U.S. Pat. No. 5,275,930. JP-A-8-220681 (the term "JP-A" as used herein means an "unexamined published Japanese patent application"), JP-A-8-234340, JP-A-8-220684, JP-A-8-240879 and JP-A-8-234345 disclose in common various designs of the incorporation of an iodide ion into a high silver chloride host grain and these patents contrive to have the largest iodide ion concentration in the sub-surface of an emulsion grain and form intentionally a high silver chloride layer not containing an iodide on the layer containing an iodide.

When an iodide ion is subjected to mixed-crystallization to a silver chloride, silver ions between lattices of the inside of a grain conspicuously increase. Therefore, the improvement of sensitization by an iodide ion seems as the acceleration of formation of a light-sensitive speck due to the increment of silver ions between lattices. Since there is not the layer containing an iodide on the surface or an iodide is limited to the corners in the above-exemplified patents, the maximum of the effect of higher sensitization cannot be brought out. Contrary to this, when an iodide ion is contained only on the outermost surface of a grain, the iodide ion adsorbed onto the outermost surface of the grain after grain formation is unstably incorporated into a silver chloride layer by the process after that, e.g., by chemical sensitization, as a result, fog is liable to occur hence unsuitable for the achievement of higher sensitization.

SUMMARY OF THE INVENTION

Accordingly, the objects of the present invention is to provide a silver halide emulsion which is low in generation of fog notwithstanding high sensitivity, excellent in a reciprocity law characteristic at high intensity illuminance, and low in fluctuations in sensitivity and gradation due to the time variation after exposure until processing, and to provide a producing method of the same and a silver halide color photographic material containing the same.

As a result of eager investigation by the present inventors, the above objects have been achieved by the following means (1) to (11).

(1) A silver halide photographic emulsion comprising silver chloroiodide grains or silver chloroiodobromide grains having 90 mol % or more of a silver chloride content, wherein the silver chloroiodide grains or silver chloroiodobromide grains have a layer having a silver iodide content of decreasing in the depth direction from the grain surface.

(2) The silver halide photographic emulsion as described in the above item (1), wherein the silver halide photographic emulsion is produced by a method of finishing the introduction of the iodide ion before 98% of the volume of the grains are formed.

(3) The silver halide photographic emulsion as described in the above item (1) or (2), wherein the introduction of the iodide ion is carried out by using silver halide fine grains containing silver iodide.

(4) A silver halide photographic emulsion comprising silver chloroiodide grains or silver chloroiodobromide grains, having 90 mol % or more of a silver chloride content, wherein the introduction of the iodide ion is carried out by using silver halide fine grains containing silver iodide which are formed by providing and mixing an aqueous solution of a water-soluble silver salt and an aqueous solution of a water-soluble halide compound containing the iodide ion in a mixing vessel which is provided separately from a reaction vessel in which a nucleation and/or grain growth of the silver halide grain is carried out.

(5) The silver halide photographic emulsion as described in the above item (3) or (4), wherein said silver halide fine grains have a grain size of 0.06 $\mu$m or less.

(6) The silver halide photographic emulsion as described in any of the above items (1) to (5), wherein the main planes of the silver chloroiodide grains or silver chloroiodobromide grains comprise {100} faces.

(7) The silver halide photographic emulsion as described in any of the above items (1) to (6), wherein the silver chloroiodide grains or silver chloroiodobromide grains contain one or more transition metal complexes.

(8) The silver halide photographic emulsion in any of the above items (1) to (7), wherein the content of the iodide ion is 0.1 mol % or more of the total silver amount of the entire emulsion grains.

(9) The silver halide photographic emulsion in any of the above items (1) to (8), wherein the content of the iodide ion is 0.06 mol % or more of the total silver amount of the entire emulsion grains and the silver halide emulsion is spectrally sensitized with a trimethine cyanine dye.

(10) The silver halide photographic emulsion as described in the above item (7) or (9), wherein the content of the iodide ion is 0.06 mol % or more of the total silver amount of the entire emulsion grains and the central metal of at least one kind of the transition metal complex is ruthenium or osmium.

(11) A silver halide color photographic material comprising a support having provided thereon at least one blue-sensitive silver halide emulsion layer, at least one green-sensitive silver halide emulsion layer and at least one red-sensitive silver halide emulsion layer, wherein at least one of the blue-sensitive silver halide emulsion layer, thee green-sensitive silver halide emulsion layer and the red-sensitive silver halide emulsion layer contains the silver halide emulsion described in any of the above items 1 to 10.

DETAILED DESCRIPTION OF THE INVENTION

Figure 1:
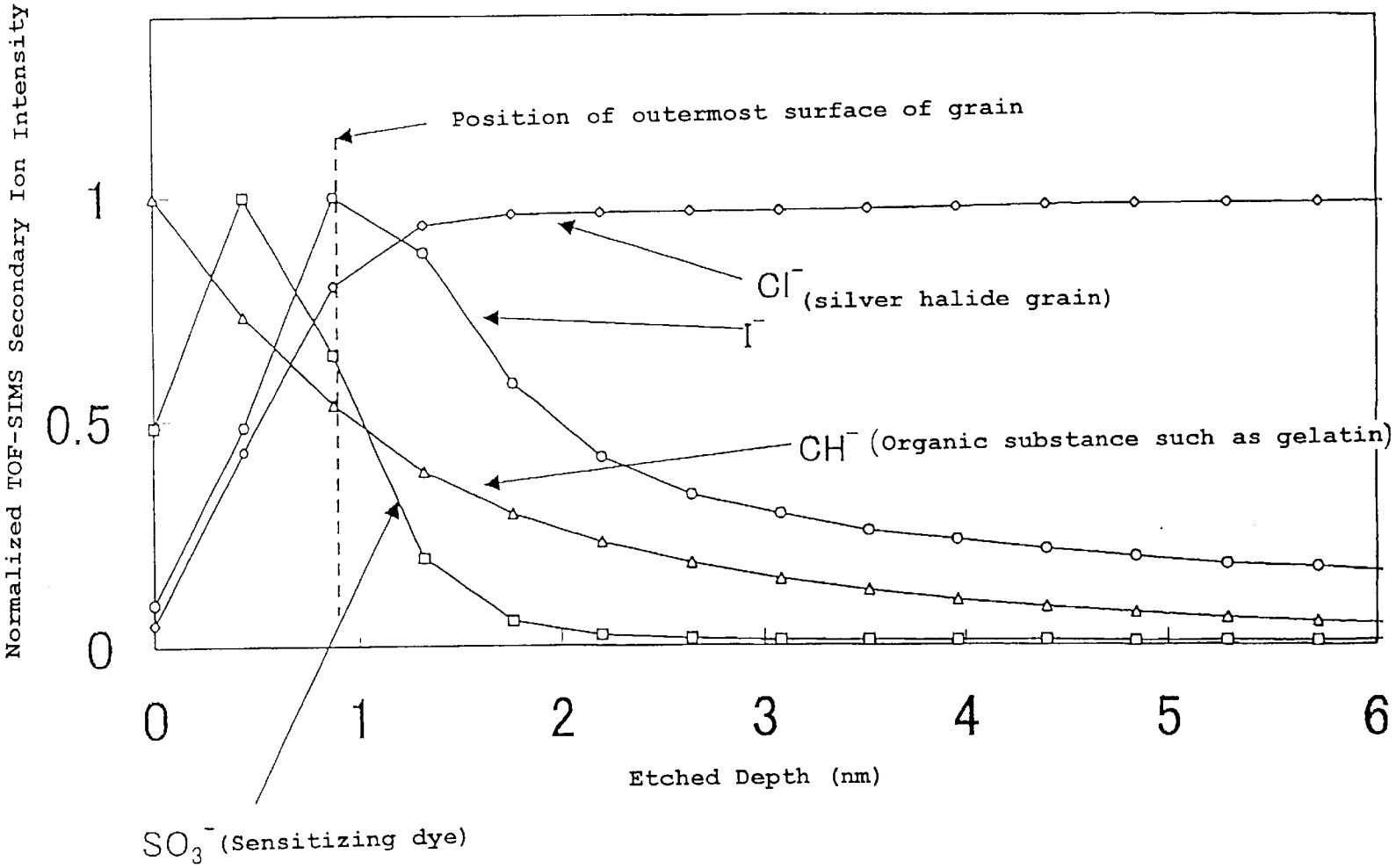
FIG. 1 is a graph for analysis by an etching/TOF-SIMS method.
Figure 2:
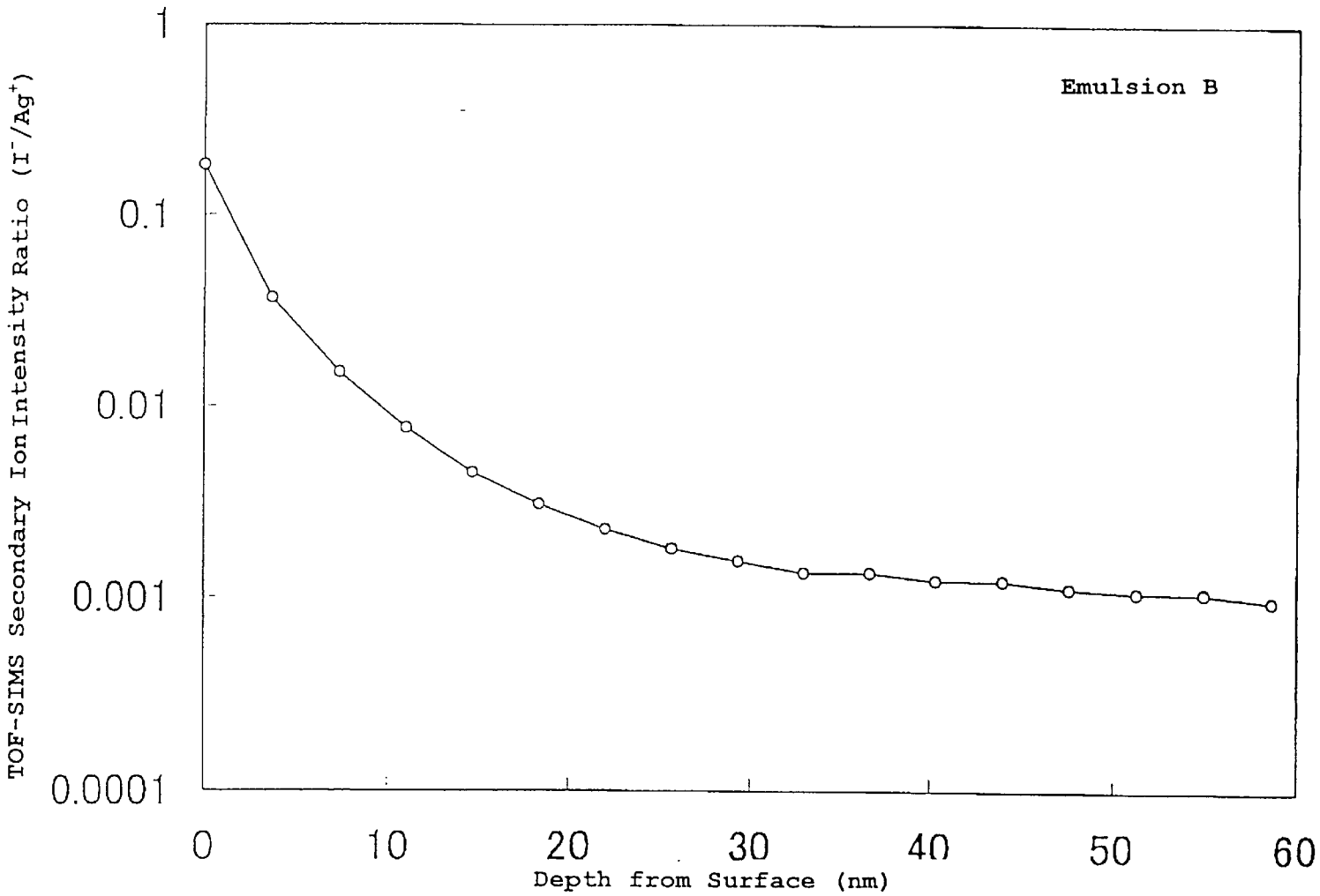
FIG. 2 shows the distribution of the iodide ion content in the depth direction in a silver halide grain by a TOF-SIMS method.
Figure 3:
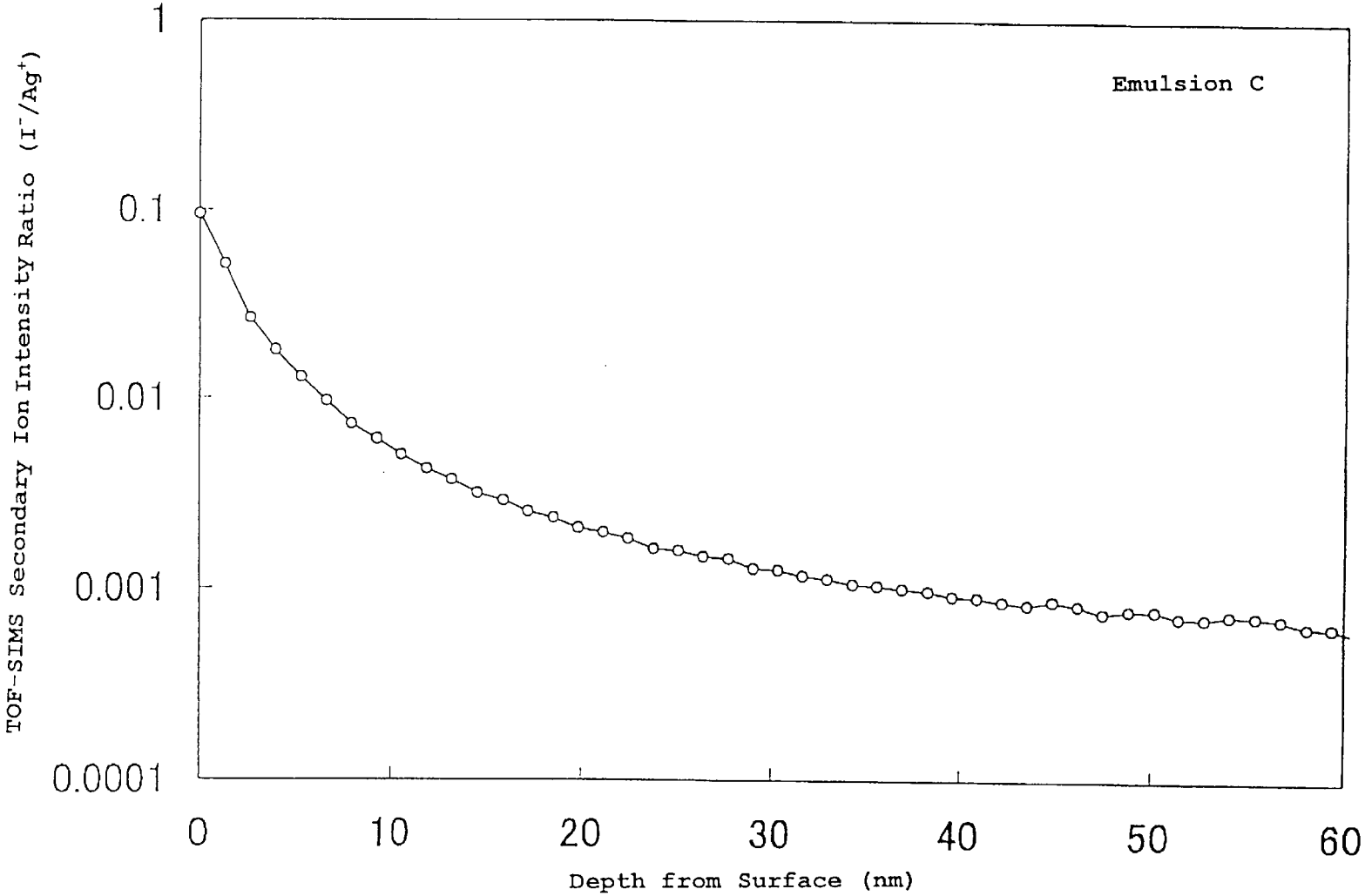
FIG. 3 shows the distribution of the iodide ion content in the depth direction in a silver halide grain by a TOF-SIMS method.
Figure 4:
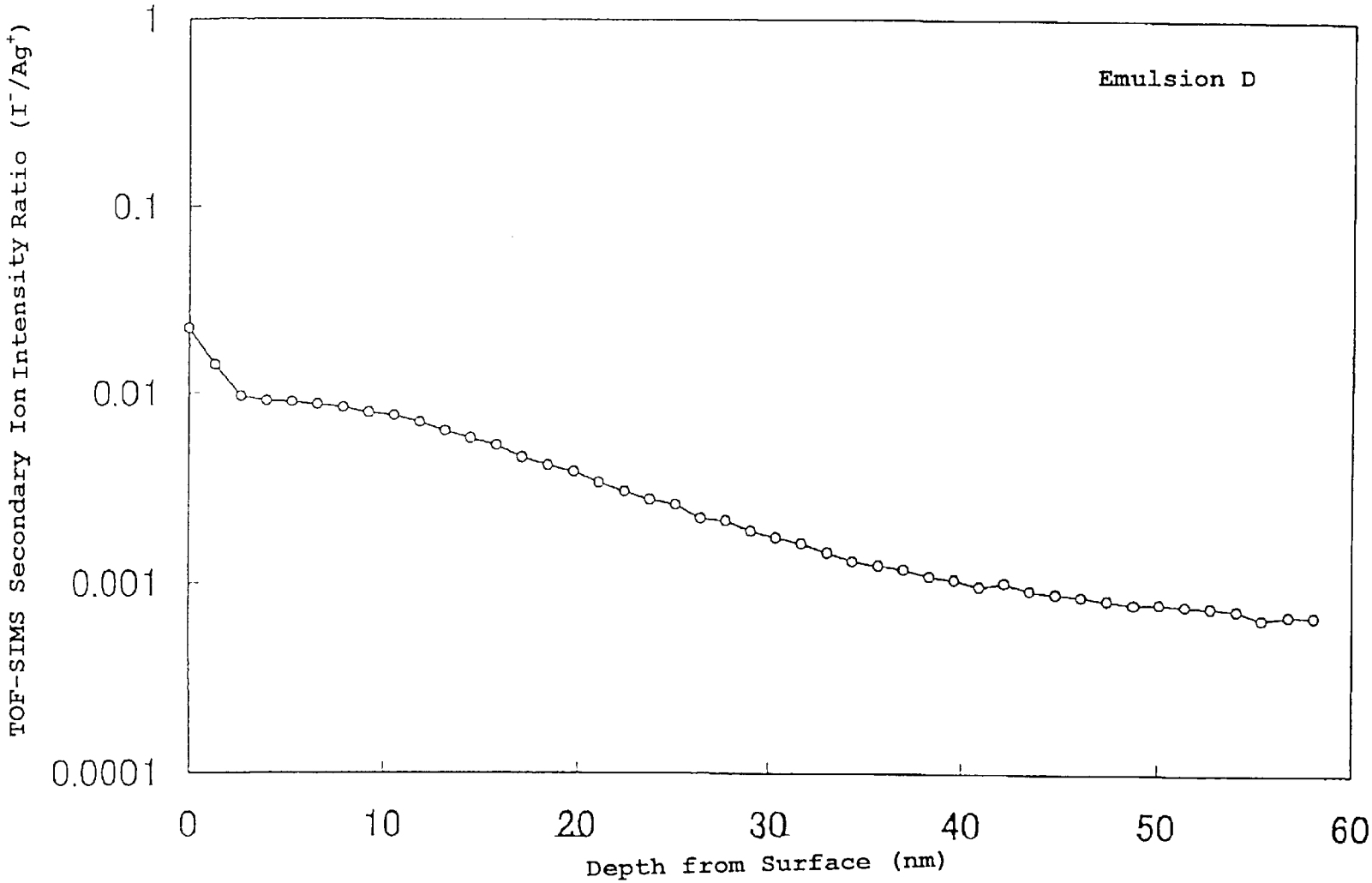
FIG. 4 shows the distribution of the iodide ion content in the depth direction in a silver halide grain by a TOF-SIMS method.
Figure 5:
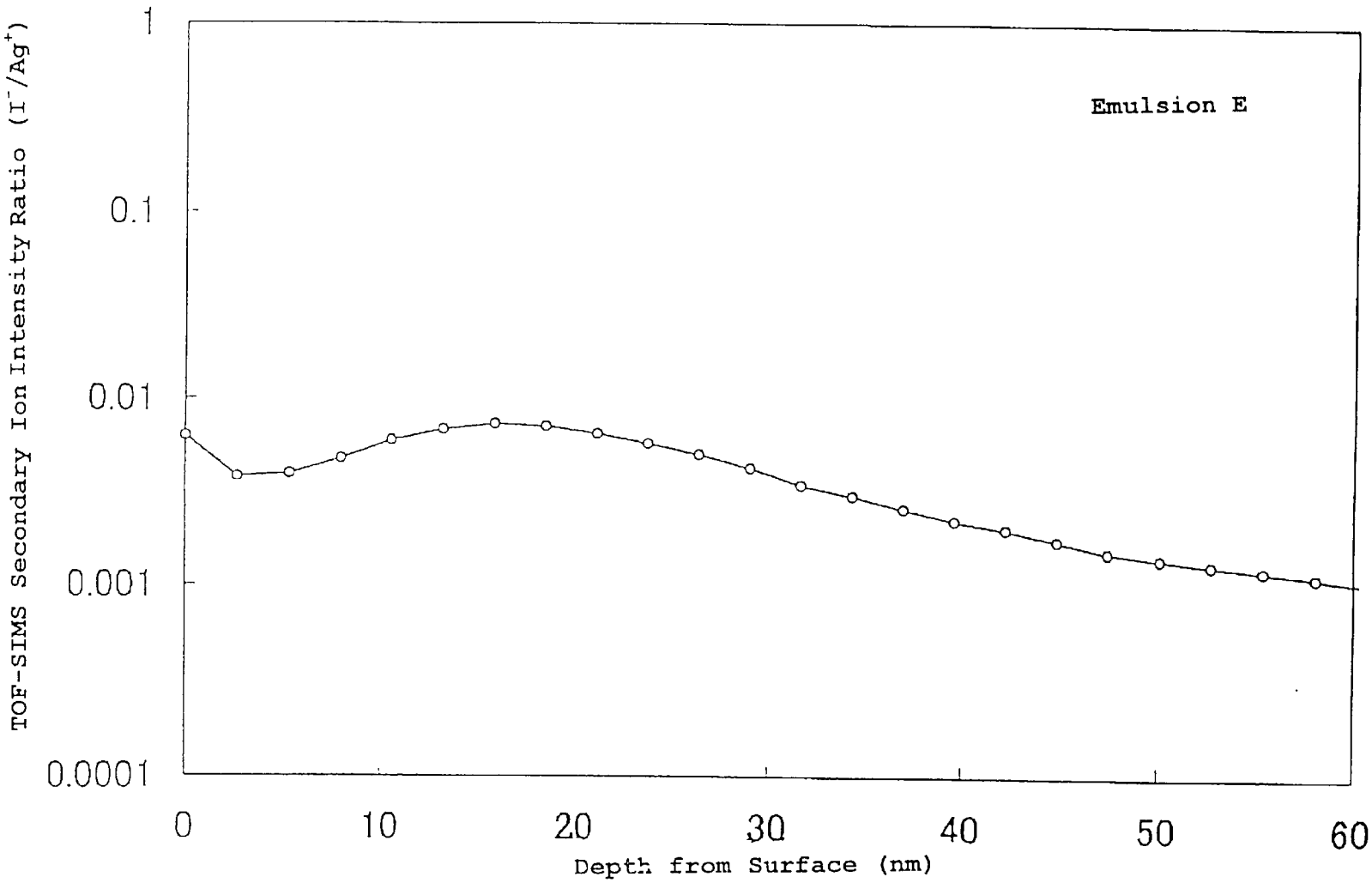
FIG. 5 shows the distribution of the iodide ion content in the depth direction in a silver halide grain by a TOF-SIMS method.
Figure 6:
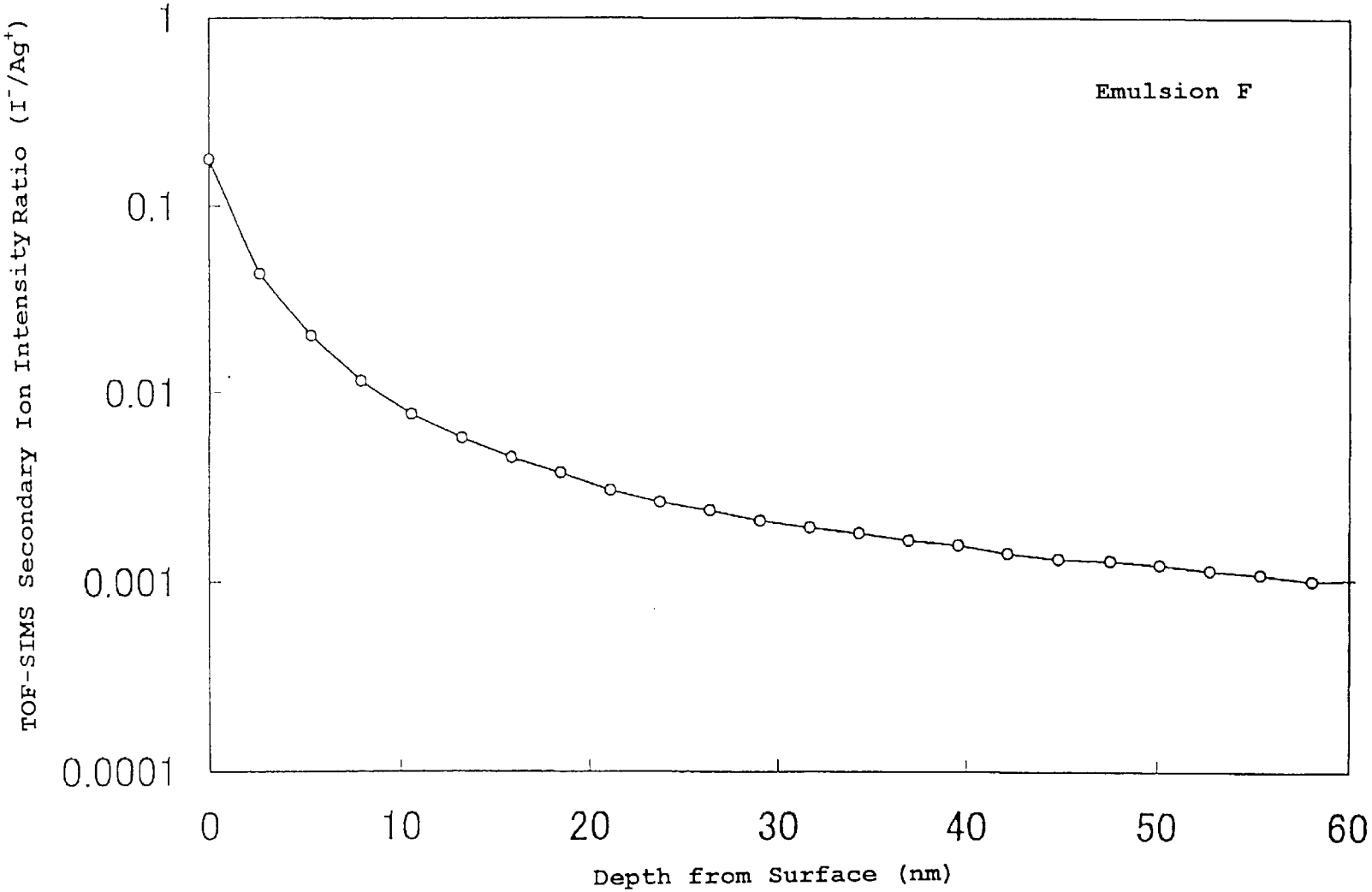
FIG. 6 shows the distribution of the iodide ion content in the depth direction in a silver halide grain by a TOF-SIMS method.
Figure 7:
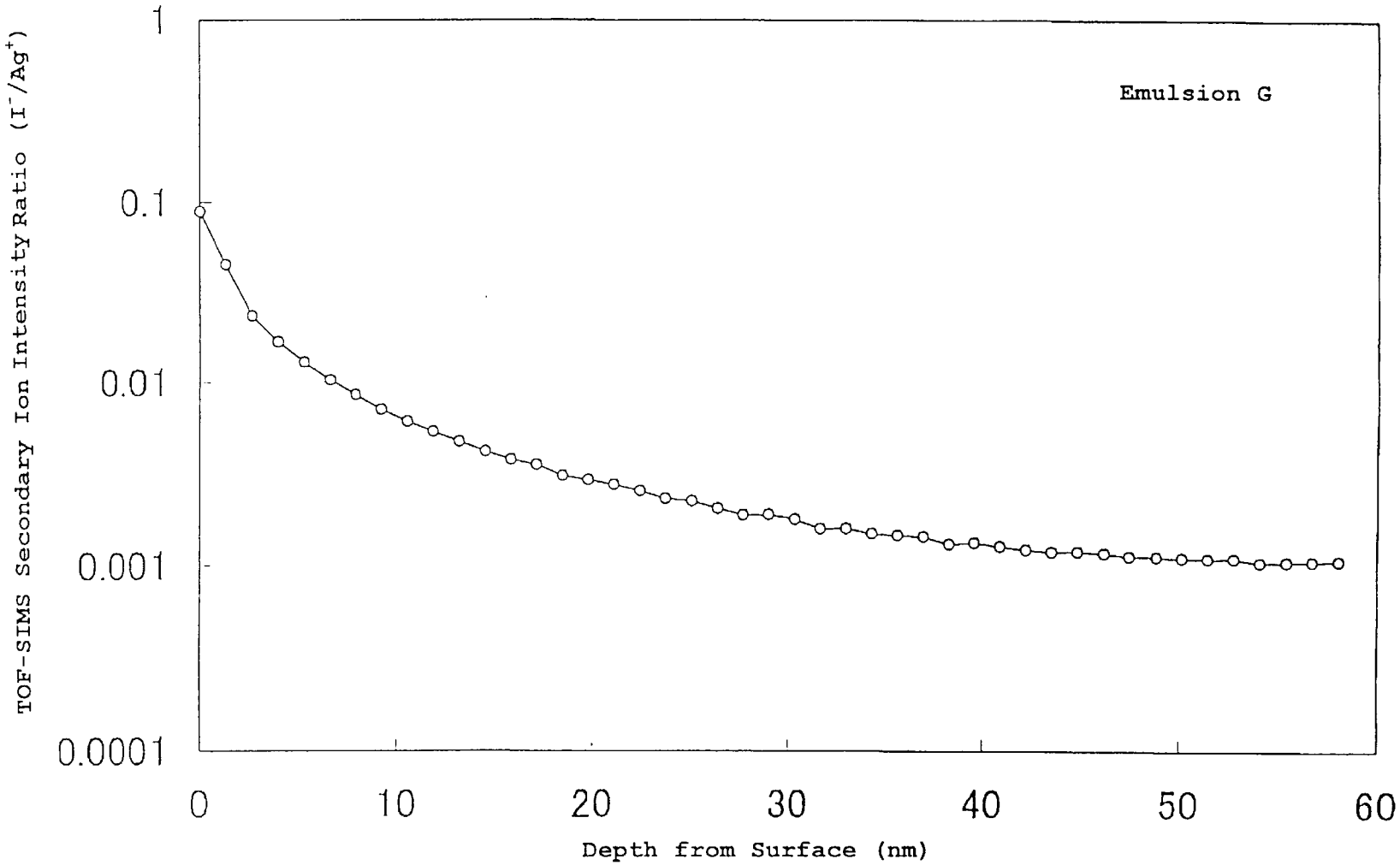
FIG. 7 shows the distribution of the iodide ion content in the depth direction in a silver halide grain by a TOF-SIMS method.

The present invention is described in detail below. The silver halide grain in the silver halide photographic emulsion for use in the present invention is preferably a cubic or tetradecahedral crystal grain (the peak of these grains may be rounded and may have a hkl plane) having substantially {100} faces or an octahedral crystal grain, or a tabular grain 50% or more of the entire projected area of which accounts for {100} faces or {111} faces having an aspect ratio of 2 or more. The aspect ratio is defined as the value obtained by dividing the diameter of a circle corresponding to the circle having the same area as a projected area by the thickness of the grain. In the present invention, cubic grains or tabular grains having {100} faces or {111} faces as main planes are preferably used.

As the silver halide emulsion for use in the present invention, silver chloroiodide emulsions or silver chloroiodobromide emulsions having a silver chloride content of 90 mol % or more are used, but from the point of a rapid processing property, silver chloroiodide emulsions or silver chloroiodobromide emulsions having a silver chloride content of 95 mol % or more, more preferably 98 mol % or more, are preferably used. Of these silver halide emulsions, emulsions having a silver iodochloride phase having an iodide ion content in the silver halide grains of from 0.01 to 1.0 mol %, more preferably from 0.05 to 0.80 mol %, and most preferably from 0.25 to 0.60 mol %, per mol of the total silver are preferably used because they can provide high sensitivity and they are excellent in a high intensity illuminance exposure suitability. Further, silver halide grains having a silver bromide local phase of from 0.2 to 5 mol %, more preferably from 0.5 to 3 mol %, per mol of the total silver, on the surfaces of the silver halide grains are particularly preferred because high sensitivity can be obtained and the stabilization of photographic performances can be contrived.

In the introduction of the iodide ion, a solution of an iodide salt may be added alone, or a solution of an iodide salt may be added with a silver salt solution and a high chloride salt solution. The latter is preferred because the iodide ion is homogenously introduced as compared with the former case and thereby the stabilization of photographic performances is obtained. In the latter case, (1) an iodide salt solution and a high chloride salt solution may be added separately, or (2) a mixed solution of an iodide salt and a high chloride salt may be added. Of these, the addition method of the above item (1) is preferred. An iodide salt is added in the form of a soluble salt such as an alkali or alkaline earth iodide salt. Further, an iodide can be added by the cleavage of an iodide ion from an organic molecule as disclosed in U.S. Pat. No. 5,389,508. Moreover, silver halide fine grains containing silver iodide can also be used as another iodide ion source.

The silver halide fine grains can be formed by using a mixing vessel described in JP-A-10-43570 which is different from a reaction vessel in which a nucleation and/or grain growth of the silver halide grain is carried out.

That is, the silver halide fine grains containing silver iodide is formed by introducing separately an aqueous solution of a water-soluble silver salt and an iodide salt solution and a high chloride salt solution in the mixing vessel or introducing an iodide salt and a high chloride salt in the mixing vessel. It is preferred that the silver halide fine grains containing silver iodide formed in the mixing vessel are added to the reaction vessel immediately after formation of the silver halide fine grains because the grain size of the silver halide fine grains is increased by the Ostwald ripening after formation of the silver halide fine grains and thereby the silver halide fine grains are dissolved in the reaction vessel with difficulty to inhibit releasing of the iodide ion.

The average projected grain size of the silver halide fine grains containing silver iodide used in the present invention is preferably from 0.001 to 0.06 $\mu$m, more preferably from 0.001 to 0.04 $\mu$m, most preferably from 0.001 to 0.02 $\mu$m.

The introduction of the iodide ion due to the silver halide fine grains containing silver iodide may be carried out by adding the silver halide fine grains alone to the reaction vessel or by adding the silver halide fine grains with the silver salt solution and the high chloride salt solution. The method using the silver halide fine grains containing silver iodide tends to introduce homogeneously the iodide ion as compared with using the aqueous solution of iodide salt.

The addition of the iodide salt solution or the silver halide fine grains containing silver halide may be concentrated at one time of grain forming process or may be performed over a certain period of time. For obtaining an emulsion which is high sensitivity and low in fog, the position of the introduction of an iodide ion to a high chloride emulsion is restricted. The deeper in the emulsion grain the iodide ion is introduced, the smaller is the increment of sensitivity. Accordingly, the addition of an iodide salt solution is preferably started at 50% or outer side of the volume of a grain, more preferably 70% or outer side, and most preferably 80% or outer side. Moreover, the addition of an iodide salt solution is preferably finished at 98% or inner side of the volume of a grain, and most preferably 96% or inner side. When the addition of an iodide salt solution is finished at a little inner side of the grain surface, the layer having a silver iodide content of decreasing in the depth direction from the surface of high silver chloride grain of the present invention can be formed, and thereby an emulsion having higher sensitivity and lower fog can be obtained.

The method of decreasing the silver iodide content in the silver iodide-containing layer is not particularly restricted. For example, the type of decreasing in progression as Emulsions B, C, F and G, and the type of extremely gradually monotonously decreasing as Emulsion D in the later-described Example 1 do not matter, but the preferred is the former type of decreasing in progression.

The distribution of an iodide ion content in the depth direction of a grain can be measured by an etching/TOF-SIMS (Time of Flight•Secondary Ion Mass Spectrometry) method with, e.g., a Model TRIFTII TOF-SIMS apparatus (manufactured by Phi Evans Co.). A TOF-SIMS method is specifically described in Nippon Hyomen Kagakukai compiled, *Hyomen Bunseki Gijutsu Sensho Niji Ion Shitsuryo Bunsekiho* (*Surface Analysis Technique Selection•Secondary Ion Mass Analytical Method*), Maruzen Co., Ltd. (1999). An iodide ion is detected by the method of etching a grain surface with a gallium ion in a TOF-SIMS apparatus and performing the mass analysis of the extreme surface of the grain by a TOF-SIMS method. In the present invention, by repeating the etching and the TOF-SIMS measurement, the distribution of the content of the iodide ion in the depth direction in the grain was evaluated. The rate of etching is found in advance, and the position of the depth is confirmed by converting the time required for etching to the depth of etching. The analytic performance of the depth of a TOF-SIMS method is several nanometers or so. FIG. 1 is the analytic result by an etching/TOF-SIMS method of a grain in which iodide is introduced into the grain when an iodide salt solution is introduced into a grain when 92% of the grain formation is finished. In FIG. 1, the depth profiles of each intensity of iodide ions and fragment ions other than the iodide ions in the vicinity of the grain surface is also shown. Secondary ion strength (Δ) of $^{13}CH^-$ derived from organic substances such as gelatin remaining on the surface of the grain decreases as etching progresses. Secondary ions of a chloride ion (◇) and an iodide ion (○) derived from a silver halide grain are not detected until organic substances such as gelatin is removed by etching. Accordingly, the outermost surface of the grain is the point shown by the dotted line in the figure and the distribution of the iodide ion content in the depth direction in the grain is evaluated with this point as the starting point.

When the emulsion according to the present invention contains a silver bromide local phase, it is preferred to form the silver bromide local phase having, at least, a silver bromide content of 10 mol % or more by epitaxial growth on the surface of the grain. The silver bromide content of the silver bromide local phase is preferably from 10 to 60 mol %, and most preferably from 20 to 50 mol %. The silver bromide local phase occupies preferably from 0.1 to 5 mol %, more preferably from 0.3 to 4 mol %, of silver of the entire silver amount comprising the silver halide grain of the present invention. It is preferred for the silver bromide local phase to contain metal complex ions belonging to the group VIII of the Periodic Table, such as iridium(III) chloride, iridium(III) bromide, iridium(IV) chloride, sodium hexachloroiridate(III), potassium hexachloroiridate(IV), hexammineiridium(IV) salt, trioxalatoiridium(III) salt, trioxalatoiridium(IV) salt, etc. The addition amount of these compounds covers a wide range according to purposes, and is preferably from $10^{-9}$ to $10^{-2}$ mol per mol of the silver halide.

In the present invention, a transition metal ion can be added during the process of a silver halide grain formation and/or grain growth and incorporate the metal ion into the silver halide grain or on the surface of the grain. The metal ions used are preferably transition metal ions, and iron, ruthenium, iridium, osmium, lead, cadmium and zinc are preferred above all. These transition metal ions are more preferably used as six-coordinated octahedral complexes having ligands. When inorganic compounds are used as the ligands, a cyanide ion, a halogenide ion, a thiocyanogen, a hydroxide ion, a peroxide ion, an azide ion, a nitrous acid ion, water, an ammonia, a nitrosyl ion, and a thionitrosyl ion are preferably used, and they are preferred to be coordinated with any of the above iron, ruthenium, iridium, osmium, lead, cadmium and zinc. It is also preferred to use a plurality of ligands in one complex molecule. Organic compounds can also be used as the ligands, and cyclic compounds having a main chain of 5 or less carbon atoms and/or a 5- or 6-membered heterocyclic compounds can be exemplified as the preferred organic compounds. The more preferred organic compounds are the compounds having a nitrogen atom, a phosphorus atom, an oxygen atom or a sulfur atom as the coordination atoms of the metal, and the most preferred compounds are furan, thiophene, oxazole, isooxazole, thiazole, isothiazole, imidazole, pyrazole, triazole, furazane, pyran, pyridine, pyridazine, pyrimidine and pyrazine, and the compounds to which substituents are introduced with these compounds as the basic skeletons (i.e., the basic structure) are also preferred.

The preferred combinations of a metal ion and a ligand are an iron ion or a ruthenium ion with a cyanide ion. In these compounds, it is preferred that a cyanide ion should account for the majority of the coordination number of iron or ruthenium which is the central metal, and that the remaining coordination positions be occupied by a thiocyanogen, an ammonia, water, a nitrosyl ion, dimethyl sulfoxide, pyridine, pyrazine, or 4,4'-bipyridine. The most preferred case is that all of six coordination positions of a central metal be occupied by cyanide ions and they form a hexacyano complex or a hexacyanoruthenium complex. The complexes having these cyanide ions as the ligands are preferably added during grain formation in an amount of from $1\times10^{-8}$ to $1\times10^{-2}$ mol, most preferably from $1\times10^{-6}$ to $5\times10^{-4}$ mol, per mol of the silver. When iridium is used as the central metal, the ligand is preferably a fluoride ion, a chloride ion, a bromide ion or an iodide ion, and a chloride ion or a bromide ion is preferred above all. The specific preferred examples of iridium complexes include $[IrCl_6]^{3-}$, $[IrCl_6]^{2-}$, $[IrCl_5(H_2O)]^{2-}$, $[IrCl_5(H_2O)]^-$, $[IrCl_4(H_2O)_2]^-$, $[IrCl_4(H_2O)_2]^0$, $[IrCl_3(H_2O)_3]^0$, $[IrCl_3(H_2O)_3]^+$, $[IrBr_6]^{3-}$, $[IrBr_6]^{2-}$, $[IrBr_5(H_2O)]^{2-}$, $[IrBr_5(H_2O)]^-$, $[IrBr_4(H_2O)_2]^-$, $[IrBr_4(H_2O)_2]^0$, $[IrBr_3(H_2O)_3]^0$, $[IrBr_3(H_2O)_3]^+$, $[IrCl_5(\text{thiazole})]^{2-}$, $[IrCl_5(\text{5-methylthiazole})]^{2-}$, $[IBr_5\ (\text{thiazole})]^{2-}$, $[IrBr_5(\text{5-methylthiazole})]^{2-}$, $[IrCl_4(\text{thiazole})_2]^-$, and $[IrCl_5(OCN)]^{3-}$. These iridium complexes is preferably added during grain formation in an amount of from $1\times10^{-10}$ to $1\times10^{-3}$ mol, most preferably from $1\times10^{-8}$ to $1\times10^{-5}$ mol, per mol of the silver. When ruthenium and osmium are used as the central metals, to use a nitrosyl ion, a thionitrosyl ion, or water molecule and a chloride ion together as the ligands is preferred. The more preferred is to form a pentachloronitrosyl complex, a pentachlorothionitrosyl complex or a pentachloroaquo complex, and to form a hexachloro complex is also preferred. These complexes are preferably added during grain formation in an amount of from $1\times10^{-10}$ to $1\times10^{-6}$ mol, more preferably from $1\times10^{-9}$ to $1\times10^{-6}$ mol, per mol of the silver.

By using a plurality of transition metal complexes in combination, the silver chloroiodide emulsions or silver chloroiodobromide emulsions of the present invention which are higher sensitivity, having high contrast gradation in a low density part, and are excellent in a reciprocity law characteristic at high intensity illuminance can be obtained. It is preferred to use at least three or more transition metal complexes for the purpose of improving high sensitivity, high contrast and a reciprocity law, and it is more preferred to use four or more transition metal complexes for obtaining the emulsions widely excellent in reciprocity law characteristics. Further, for obtaining high contrast gradation in a low density part, it is most preferred that at least one of the complexes to be used be a transition metal complex having ruthenium or osmium as the central metal.

It is preferred in the present invention to incorporate these complexes into a silver halide grain by directly adding them to a reaction solution during silver halide grain formation, or adding to an aqueous halide solution for forming silver halide grains or other solution in advance and adding the solution to a reaction solution for forming silver halide grains afterward. Further, these methods may be used in combination to incorporate the above complexes into a silver halide grain.

When these complexes are incorporated into a silver halide grain, it is preferred that they are incorporated into the inside of a grain homogeneously, but it is also preferred that they are localized on the surface layer of a grain as disclosed in JP-A-4-208936, JP-A-2-125245 and JP-A-3-188437. It is further preferred that the complexes are present only in a grain and a layer not containing the complexes is provided on the surface of a grain. Further, as disclosed in U.S. Pat. Nos. 5,252,451 and 5,256,530, it is preferred that fine grains having incorporated the complexes are subjected to physical ripening to thereby modify the grain surfaces. These methods can be used in combination, and a plurality of complexes may be incorporated into one silver halide grain. The halogen composition of the position into which the above complexes are incorporated is not particularly restricted, and the complexes may be incorporated into any of a silver chloride layer, a silver chlorobromide layer, a silver bromide layer, a silver iodochloride layer and a silver iodobromide layer.

The silver halide grains contained in the silver halide emulsion for use in the present invention have an average grain size (the diameter of a circle corresponding to the projected area is a grain size and number average of the diameters is taken as an average grain size) of generally from 0.1 μm to 2 μm, preferably from 0.1 μm to 0.7 μm, more preferably from 0.1 μm to 0.38 μm, and most preferably from 0.1 μm to 0.2 μm.

The grain size distribution of these grains is preferably so-called monodispersion having variation coefficient (the value obtained by dividing the standard deviation of the grain size distribution by the average grain size) of generally 20% or less, preferably 15% or less, and more preferably 10% or less. For obtaining a wide latitude, it is also preferred to blend and use the above described monodispersed emulsions in one and the same layer or they are multilayer-coated.

Various compounds and the precursors of them can be added to the silver halide emulsion for use in the present invention for the purpose of preventing the generation of fog or stabilizing the photographic performances during production, storage or processing of the photographic material. The compounds disclosed in JP-A-62-215272, pp. 39 to 72 are preferably used in the present invention. A 5-arylamino-1,2,3,4-thiatriazole compound (the aryl residue has at least one electron attracting group) disclosed in EP 0447647 is also preferably used.

For increasing the storage stability of the silver halide emulsion, the hydroxamic acid derivatives disclosed in JP-A-11-109576, the cyclic ketone rings having double bonds substituted with an amino group or a hydroxyl group at both terminals disclosed in JP-A-11-327094 (in particular, the compound represented by formula (S1) is preferred and the specific examples disclosed in paragraphs 0036 to 0071 of the same patent can be incorporated into the present invention) the sulfo-substituted catechol and hydroquinones disclosed in JP-A-11-143011 (e.g., 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxy-benzenesulfonic acid, and salts of these compounds), and the water-soluble reducing agents represented by formulae (I) to (III) can also be preferably used in the present invention.

Spectral sensitization is performed for the purpose of giving spectral sensitivity to a desired wavelength range of light to the emulsion in each layer of the photographic material of the present invention.

In the photographic material of the present invention, as the spectral sensitizing dyes for use in spectral sensitization of the regions of blue, green and red, the compounds described, e.g., in F. M. Harmer, *Heterocyclic Compounds-Cyanine Dyes and Related Compounds,* John Wiley & Sons, New York, London (1964) are exemplified. The compounds and spectral sensitizing methods disclosed in JP-A-62-215272, right upper column, page 22 to page 38 are preferably used. Further, as the red-sensitive spectral sensitizing dye for silver halide emulsion grains having a high silver chloride content, the spectral sensitizing dyes disclosed in JP-A-3-123340 are very preferred from the viewpoint of stability, adsorption strength and the temperature dependency of exposure.

A trimethine cyanine dye represented by the following formula (I) is preferably used as the spectral sensitizing dye of the green-sensitive region, and oxatrimethine cyanine dyes and oxazolotrimethine cyanine dyes are most preferably used.

(I)

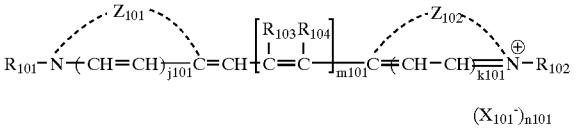

wherein $Z_{101}$ and $Z_{102}$ each represents an atomic group necessary to form a nitrogen-containing heterocyclic nucleus. As the nitrogen-containing heterocyclic nucleus, a 5- or 6-membered heterocyclic nucleus containing a nitrogen atom, in addition, a sulfur atom, an oxygen atom, a selenium atom or a tellurium atom as hetero atoms is preferred. A condensed ring and a substituent may be further bonded to these rings. As the specific examples of the nitrogen-containing heterocyclic nuclei, a thiazole nucleus, a benzothiazole nucleus, a naphthothiazole nucleus, a selenazole nucleus, a benzoselenazole nucleus, a naphthoselenazole nucleus, an oxazole nucleus, a benzoxazole nucleus, a naphthoxazole nucleus, an imidazole nucleus, a benzimidazole nucleus, a naphthoimidazole nucleus, a 4-quinoline nucleus, a pyrroline nucleus, a pyridine nucleus, a tetrazole nucleus, an indolenine nucleus, a benzindolenine nucleus, an indole nucleus, a tellurazole nucleus, a benzotellurazole nucleus, and a naphthotellurazole nucleus can be exemplified. $R_{101}$ and $R_{102}$ each represents an alkyl group, an alkenyl group, an alkynyl group or an aralkyl group. These groups and the groups described below are used in the meaning of including the substituent of each group. For example, to take the alkyl group as an example, the alkyl group includes a substituted and an unsubstituted alkyl groups, and these groups may be straight chain, branched or cyclic alkyl groups. The alkyl group preferably has from 1 to 8 carbon atoms.

As the specific examples of the substituents of the unsubstituted alkyl groups, a halogen atom (e.g., fluorine, chlorine, bromine, iodine), a cyano group, an alkoxyl group, a substituted or unsubstituted amino group, a carboxylic acid group, a sulfonic acid group and a hydroxyl group can be exemplified. These groups may substitute alone or in combination of two or more. As the specific examples of the alkenyl group, a vinylmethyl group can be exemplified, and as the specific examples of the aralkyl group, a benzyl group and a phenethyl group can be exemplified.

$m_{101}$ represents 1. $R_{103}$ represents a hydrogen atom, a lower alkyl group, an aralkyl group or an aryl group. The specific examples of the above aryl group includes a substituted or unsubstituted phenyl group can be exemplified. $R_{104}$ represents a hydrogen atom.

$j_{101}$ and $k_{101}$ each represents 0 or 1, $X^-_{101}$ represents an acid anion, and $n_{101}$ represents 0 or 1.

The specific examples of the compounds represented by formula (I) are shown below, but the present invention is not limited thereto.

S-1

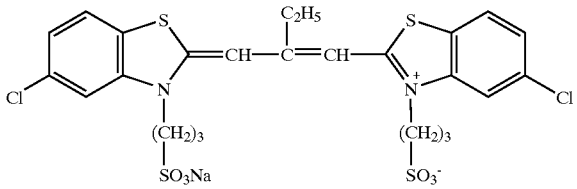

S-2

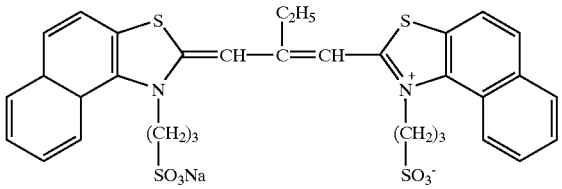

-continued

S-3

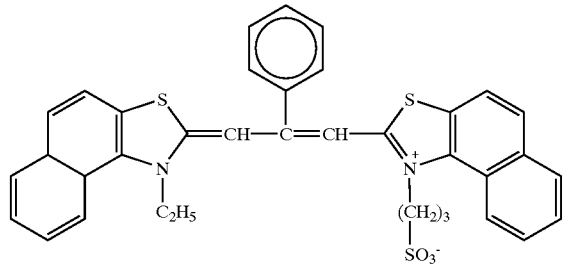

S-4

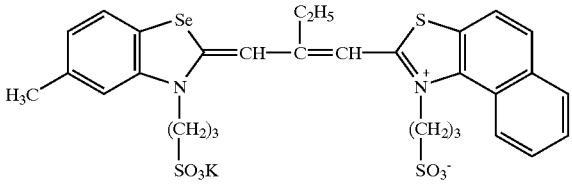

S-5

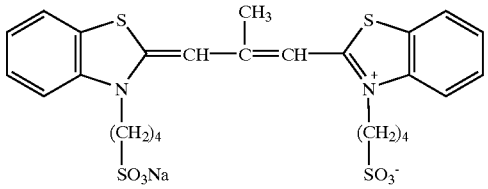

S-6

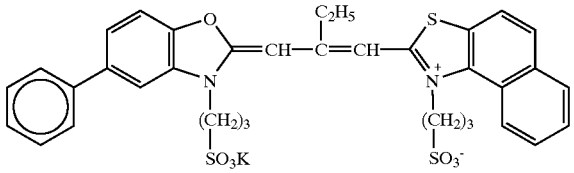

S-7

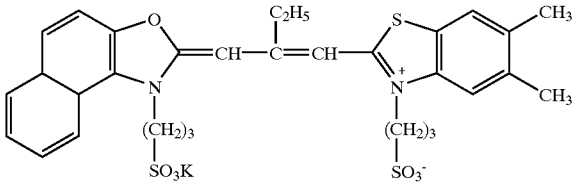

S-8

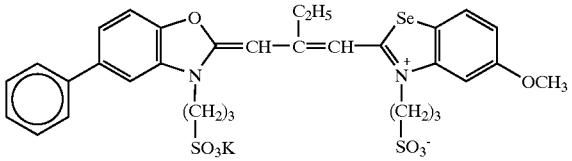

S-9

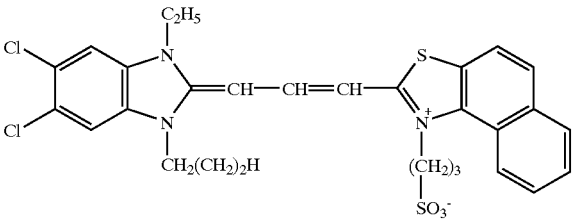

-continued

S-10

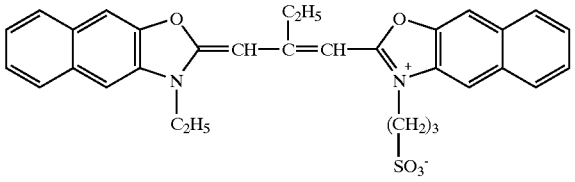

S-11

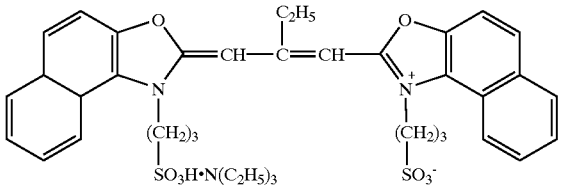

S-12

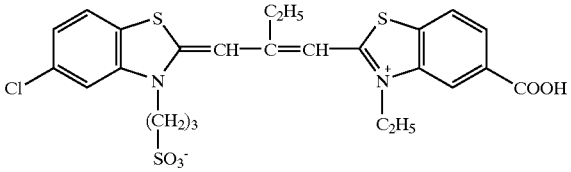

S-13

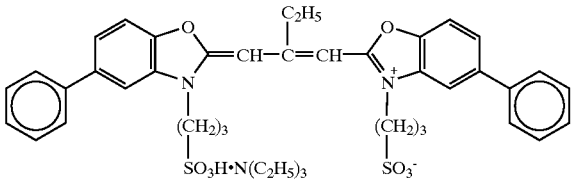

S-14

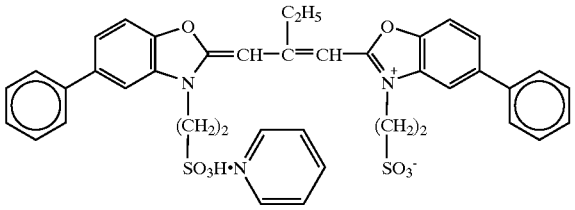

S-15

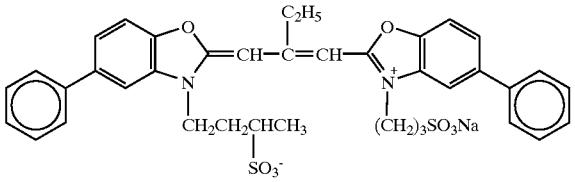

S-16

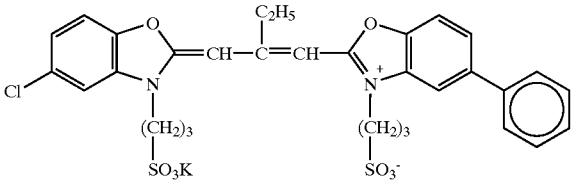

-continued

S-17

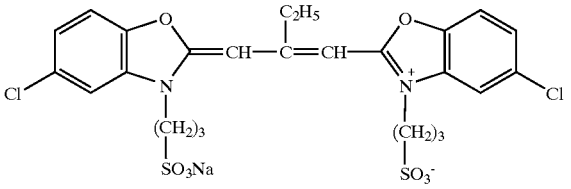

S-18

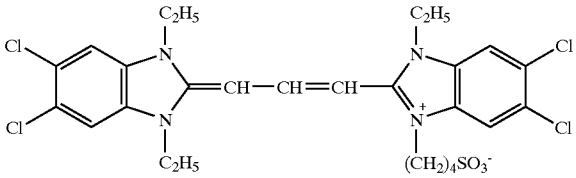

S-19

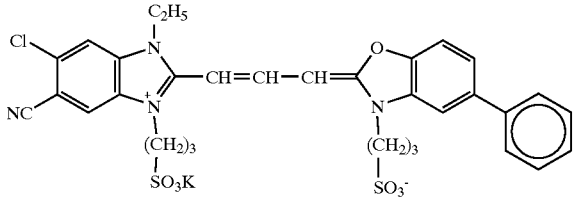

S-20

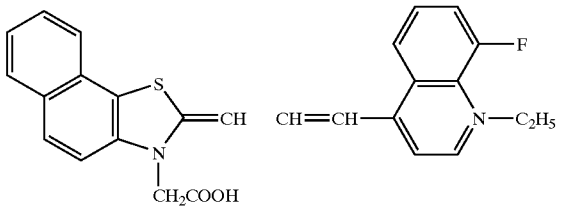

The addition amount of these spectral sensitizing dyes covers a wide range according to purposes, and is preferably from $0.5\times10^{-6}$ mol to $1.0\times10^{-2}$ mol, and more preferably from $1.0\times10^{-6}$ mol to $5.0\times10^{-3}$ mol, per mol of the silver halide.

The silver halide emulsion for use in the present invention is generally chemically sensitized. With respect to chemical sensitization methods, sulfur sensitization represented by the addition of labile sulfur compounds, noble metal sensitization represented by gold sensitization, or reduction sensitization can be used alone or in combination. The compounds disclosed in JP-A-62-215272, right lower column, p. 18 to right upper column, p. 22 are preferably used in chemical sensitization. A silver halide emulsion subjected to gold sensitization is particularly preferably used in the present invention, since the fluctuation in photographic performances can be further lessened by undergoing gold sensitization when a photographic material is subjected to scanning exposure with laser, etc.

For subjecting the silver halide emulsion for use in the present invention to gold sensitization, various kinds of inorganic gold compounds, gold (I) complexes having inorganic ligands and gold (I) compounds having organic ligands can be used. As the inorganic gold compounds, e.g., chloroauric acid and its salt, as the gold (I) complexes having inorganic ligands, e.g., dithiocyanic acid gold compounds such as potassium dithiocyanatoaurate (I), and trisodium dithio-sulfatoaurate (I) can be used.

As the gold (I) compounds having organic ligands, bis-gold (I) mesoionic heterocyclic rings, e.g., gold (I) tetrafluoroborate bis (1,4,5-trimethyl-1,2,4-triazolium-3-thiolato) disclosed in JP-A-4-267249, organic mercapto gold (I) complex, e.g., potassium bis{1-[3-(2-sulfonatobenzamido)-phenyl]-5-mercaptotetrazole potassium salt}aurate (I) pentahydrate disclosed in JP-A-11-218870, and gold (I) compounds coordinated with nitrogen compound anions, e.g., bis(1-methylhydantoinato) gold (I) sodium salt tetrahydrate disclosed in JP-A-4-268550 can be used. Further, gold (I) thiolate compounds disclosed in U.S. Pat. No. 3,503,749, gold compounds disclosed in JP-A-8-69074, JP-A-8-69075 and JP-A-9-269554, and compounds disclosed in U.S. Pat. Nos. 5,620,841, 5,912,112, 5,620,841, 5,939,245 and 5,192,111 can also be used.

The addition amount of these compounds covers a wide range according to purposes, and is generally from $5\times10^{-7}$ mol to $5\times10^{-3}$ mol, and preferably from $5\times10^{-6}$ mol to $5\times10^{-4}$ mol, per mol of the silver halide.

It is also possible to use colloidal gold sulfide, and the producing method of colloidal gold sulfide is described in *Research Disclosure,* 37154, *Solid State Ionics,* Vol. 79, pp. 60 to 66 (1995), and *Compt. Rend. Hebt. Seances, Acad. Sci. Sect. B,* Vol. 263, p. 1328 (1966). Various sizes of colloidal gold sulfides, e.g., those having a particle size of 50 $\mu$m or less, can be used. The addition amount of colloidal gold sulfides covers a wide range according to purposes, and is generally from $5\times10^{-7}$ mol to $5\times10^{-3}$ mol, and preferably from $5\times10^{-6}$ mol to $5\times10^{-4}$ mol, per mol of the silver halide.

In the present invention, gold sensitization may be combined with other sensitization methods, e.g., sulfur sensitization, selenium sensitization, tellurium sensitization, reduction sensitization, or noble metal sensitization using noble metals other than gold compounds.

Conventionally well-known photographic materials and additives can be used in the silver halide photographic material of the present invention.

For example, as the photographic supports, a transparent support and a reflective support can be used. As the transparent support, transparent films such as cellulose nitrate films and polyethylene terephthalate, polyesters of 2,6-naphthalenedicarboxylic acid (NDCA) with ethylene glycol (EG) and polyesters of NDCA with terephthalic acid and EG on which a data-recording layer such as a magnetic layer are provided are preferably used. As the reflective support, reflective supports laminated with a plurality of waterproof resin layers such as a polyethylene layer and a polyester layer at least one of which contains a white pigment, e.g., a titanium oxide, are particularly preferred.

A more preferred reflective support in the present invention is a paper substrate having a polyolefin layer on the side on which a silver halide emulsion layer is provided with minute voids. The polyolefin layer may be a plurality of layers, and in such a case, a paper substrate comprising a polyolefin layer adjacent to a gelatin layer on the silver halide emulsion layer side not having minute voids (e.g., polypropylene, polyethylene), and a polyolefin layer nearer to the paper substrate having minute voids (e.g., polypropylene, polyethylene) is more preferred. The density of these multilayer or monolayer polyolefin layer(s) provided between the paper substrate and a photographic constitutional layers is preferably from 0.40 to 1.0 g/ml, more preferably from 0.50 to 0.70 g/ml. Further, the thickness of these multilayer or monolayer polyolefin layer(s) provided between the paper substrate and a photographic constitutional layers is preferably from 10 to 100 $\mu$m, more preferably from 15 to 70 $\mu$m. Moreover, the ratio of a polyolefin layer to a paper substrate is from 0.05 to 0.5, more preferably from 0.1 to 0.2.

Further, it is also preferred to provide a polyolefin layer on the side of the paper substrate opposite to the side on which photographic constitutional layers are provided (the back side) in view of increasing the rigidity of the reflective support. In this case, the backing polyolefin layer is preferably polyethylene or polypropylene the surface of which is mutted, more preferably polypropylene. The thickness of the backing polyolefin layer is preferably from 5 to 50 $\mu$m, more preferably from 10 to 30 $\mu$m, and the density of the backing polyolefin layer is preferably from 0.7 to 1.1 g/ml. The examples of the preferred embodiments of the polyolefin layer provided on the paper substrate in the reflective support in the present invention are disclosed in JP-A-10-333277, JP-A-10-333278, JP-A-11-52513, JP-A-11-65024, EP 0880065 and EP 0880066.

It is preferred for the above waterproof resin layer to contain a brightening agent. A brightening agent may be dispersed in a hydrophilic colloid layer of a photographic material. As brightening agents, benzoxazole-based, coumarin-based and pyrazoline-based brightening agents are preferably used, and more preferably benzoxazolylnaphthalene-based and benzoxazolylstilbene-based are used. The use amount of a brightening agent is not especially restricted, and preferably from 1 to 100 mg/m$^2$. When a brightening agent is mixed in a waterproof resin, it is preferably added in an amount of from 0.0005 to 3% by weight, more preferably from 0.001 to 0.5% by weight, based on the resin.

The reflective support may be a transmission type support or a reflective support as described above provided with a hydrophilic colloid layer containing a white pigment.

The reflective support may also be a support having a metal surface having a mirror reflective property or second kind diffuse reflecting property.

As the support for the photographic material according to the present invention, a white polyester-based support or a support having a layer containing a white pigment provided on the side of the support on which a silver halide emulsion layer is provided may be used for display. Further, for increasing sharpness, it is preferred to provide an antihalation layer on the side of the support on which a silver halide emulsion layer is coated or the backside of the support. In particular, it is preferred to set the transmission density of the support in the range of from 0.35 to 0.8 so that a display can be observed with a reflected light or a transmitted light.

In the photographic material according to the present invention, for increasing the sharpness of an image, it is preferred to add the dyes decolorable by processing (above all, an oxonol-based dye) to a hydrophilic colloid layer as disclosed in EP-A-0337490, pp. 27 to 76 so that the optical reflection density of the photographic material at wavelength of 680 nm becomes 0.70 or more, or to add 12% by weight or more (preferably 14% by weight or more) of titanium oxide surface-treated with dihydric to tetrahydric alcohols (e.g., trimethylolethane) to a waterproof resin layer.

In the photographic material according to the present invention, for the purpose of preventing irradiation and halation and improving safelight safety, it is preferred to add the dyes decolorable by processing (above all, an oxonol-based dye and a cyanine dye) to a hydrophilic colloid layer as disclosed in EP-A-0337490, pp. 27 to 76. Further, the dyes disclosed in EP 0819977 are also preferably used in the present invention.

Some of these water-soluble dyes worsen color separation and safelight safety when the use amount is increased. As the dyes which can be used without worsening color separation, the water-soluble dyes disclosed in JP-A-5-127324, JP-A-5-127325 and JP-A-5-216185 are preferred.

In the present invention, in place of or in combination with water-soluble dyes, a colored layer decolorable by processing can be used. The colored layer decolorable by processing may be contiguous to an emulsion layer or may be arranged so as to be contiguous to an emulsion layer with interposing an intermediate layer containing gelatin or a color mixing preventive such as hydroquinone between the colored layer and the support. It is preferred that the colored layer is provided as the under layer of an emulsion layer (the support side of the emulsion layer) which colors in the same kind of elementary color as the colored layer. It is possible to provide every colored layer corresponding to each elementary color or only a part can be provided arbitrarily. It is also possible to provide a colored layer colored in colors corresponding to a plurality of elementary color regions. The optical reflection density of a colored layer is preferably such that the optical density value at the wavelength of the highest optical density in the wavelength region used in exposure (a visible light region of from 400 nm to 700 nm in general printer exposure, and the wavelength of the scanning exposure light source used in the case of scanning exposure) is preferably from 0.2 to 3.0, more preferably from 0.5 to 2.5, and particularly preferably from 0.8 to 2.0.

Well-known methods can be used to form a colored layer. For example, there are a method of adding a dye to a hydrophilic colloid layer in a state of solid fine particle dispersion, such as the dyes disclosed in JP-A-2-282244, right upper column, p. 3 to p. 8, and the dyes disclosed in JP-A-3-7931, right upper column, p. 3 to left lower column, p. 11, a method of mordanting an anionic dye to a cationic polymer, a method of adsorbing a dye onto fine grains of, e.g., a silver halide, and fixing into a layer, and a method of using a colloidal silver as disclosed in JP-A-1-239544. As the method of dispersing the fine particles of a dye in a solid state, a method of adding a dye which is substantially water-insoluble at pH 6 or less but is substantially water-soluble at pH 8 or more is disclosed in JP-A-2-308244, pp. 4 to 13. The method of mordanting an anionic dye to a cationic polymer is disclosed in JP-A-2-84637, pp. 18 to 26. The producing method of a colloidal silver as a light absorber is disclosed in U.S. Pat. Nos. 2,688,601 and 3,459,563. The method of adding a fine particle dye and the method of using a colloidal silver are preferably used of these methods.

The photographic material according to the present invention can be used for a color negative film, a color positive film, a color reversal film, a color reversal photographic paper and a color photographic paper, and it is preferred to be used as a color photographic paper.

It is preferred that a color photographic paper should have at least one yellow-coloring silver halide emulsion layer, at least one magenta-coloring silver halide emulsion layer, and at least one cyan-coloring silver halide emulsion layer. These silver halide emulsion layers are in general arranged in order of a yellow-coloring silver halide emulsion layer, a magenta-coloring silver halide emulsion layer, and a cyan-coloring silver halide emulsion layer from the side nearer to the support.

However, the layer constitution may be different from the above.

A silver halide emulsion layer containing a yellow coupler may be arranged anywhere on a support, but when silver halide tabular grains are contained in a yellow coupler-containing layer, it is preferred that a yellow coupler-containing layer be coated farther than at least one of a magenta coupler-containing silver halide emulsion layer and a cyan coupler-containing silver halide emulsion layer from the support. Further, in view of acceleration of color development, acceleration of desilvering and a reduction in residual color by sensitizing dyes, a yellow coupler-containing silver halide emulsion layer is preferably coated at the position farthest from the support. Moreover, for reducing discoloration due to blixing, a cyan coupler-containing silver halide emulsion layer is preferably a central layer of all the silver halide emulsion layers, and for reducing discoloration due to light, a cyan coupler-containing silver halide emulsion layer is preferably a lowermost layer. Each of yellow, magenta and cyan color-forming layers may comprise two or three layers. For example, it is also preferred to provide a coupler layer not containing a silver halide emulsion as a coloring layer contiguously to a silver halide emulsion layer as disclosed in JP-A-4-75055, JP-A-9-114035, JP-A-10-246940 and U.S. Pat. No. 5,576,159.

As the silver halide emulsions, other materials (e.g., additives), photographic constitutional layers (layer arrangement), and processing methods and additives applicable for processing the photographic material which can be applied to the present invention, those disclosed in JP-A-62-215272, JP-A-2-33144 and EP-A-0355660, in particular, those disclosed in EP-A-0355660 are preferably used. Further, the silver halide photographic materials and the processing methods of them disclosed in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, and EP-A-0520457 are also preferably used.

With respect to the above-described reflective supports and the silver halide emulsions, further the kinds of foreign metal ions which are doped in silver halide grains, storage stabilizers and antifoggants for silver halide emulsions, chemical sensitization methods (sensitizers), spectral sensitization methods (spectral sensitizers), cyan, magenta and yellow couplers and emulsifying dispersion methods of them, color image storing improvers (antistaining agents and discoloration inhibitors), dyes (coloring layers), kinds of gelatins, and the layer constitutions and pH of the coated films of photographic materials in the present invention, those disclosed in the patents summarized in the following Tables 1 and 2 are preferably used.

TABLE 1

| Photographic Constitutional Element | JP-A-7-104448 | JP-A-7-77775 | JP-A-7-301895 |
|---|---|---|---|
| Reflective support | column 7, l. 12 to column 12, l. 19 | column 35, l. 43 to column 44, l. 1 | column 5, l. 40 to column 9, l. 26 |
| Silver halide emulsion | column 72, l. 29 to column 74, l. 18 | column 44, l. 36 to column 46, l. 29 | column 77, l. 48 to column 80, l. 28 |

TABLE 1-continued

| Photographic Constitutional Element | JP-A-7-104448 | JP-A-7-77775 | JP-A-7-301895 |
|---|---|---|---|
| Kind of foreign ion | column 74, l. 19 to the same column, l. 44 | column 46, l. 30 to column 47, l. 5 | column 80, l. 29 to column 81, l. 6 |
| Storage stabilizer and antifoggant | column 75, l. 9 to the same column, l. 18 | column 47, l. 20 to the same column, l. 29 | column 18, l. 11 to column 31, l. 37 (in particular, mercapto heterocyclic compound) |
| Chemical sensitizing method (chemical sensitizer) | column 74, l. 45 to column 75, l. 6 | column 47, l. 7 to the same column, l. 17 | column 81, l. 9 to the same column, l. 17 |
| Spectral sensitizing method (spectral sensitizer) | column 75, l. 19 to column 76, l. 45 | column 47, l. 30 to column 49, l. 6 | column 81, l. 21 to column 82, l. 48 |
| Cyan coupler | column 12, l. 20 to column 39, l. 49 | column 62, l. 50 to the same column, l. 16 | column 88, l. 49 to column 89, l. 16 |
| Yellow coupler | column 87, l. 40 to column 88, l. 3 | column 63, l. 17 to the same column, l. 30 | column 89, l. 17 to the same column, l. 30 |
| Magenta coupler | column 88, l. 4 to the same column, l. 18 | column 63, l. 3 to column 64, l. 11 | column 31, l. 34 to column 77, l. 44; column 88, l. 32 to the same column, l. 46 |
| Emulsifying dispersion method of coupler | column 71, l. 3 to column 72, l. 11 | column 61, l. 36 to the same column, l. 49 | column 87, l. 35 to the same column, l. 48 |

TABLE 2

| Photographic Constitutional Element | JP-A-7-104448 | JP-A-7-77775 | JP-A-7-301895 |
|---|---|---|---|
| Color image storing improver (antistaining agent) | column 39, l. 50 to column 70, l. 9 | column 61, l. 50 to column 62, l. 49 | to column 87, l. 49 to column 88, l. 48 |
| Discoloration inhibitor | column 70, l. 10 to column 71, l. 2 | — | — |
| Dye (coloring layer) | column 77, l. 42 to column 78, l. 41 | column 7, l. 14 to column 19, l. 42; column 50, l. 3 to column 51, l. 14 | column 9, l. 27 to column 18, l. 10 |
| Kind of gelatin | column 78, l. 42 to the same column, l. 48 | column 51, l. 15 to the same column, l. 20 | column 83, l. 13 to the same column, l. 19 |
| Layer constitution of photographic material | column 39, l. 11 to the same column, l. 26 | column 44, l. 2 to the same column, l. 35 | column 31, l. 38 to column 32, l. 33 |
| pH of coated film of photographic material | column 72, l. 12 to the same column, l. 28 | — | — |
| Scanning exposure | column 76, l. 6 to column 77, l. 41 | column 49, l. 7 to column 50, l. 2 | column 82, l. 49 to column 83, l. 12 |
| Preservative in developing solution | column 88, l. 19 to column 89, l. 22 | — | — |

In addition to those described in Tables 1 and 2, cyan, magenta and yellow couplers disclosed in JP-A-62-215272, line 4, right upper column, page 91 to line 6, left upper column, page 121; JP-A-2-33144, line 14, right upper column, page 3 to the last line, left upper column, page 18; JP-A-2-33144, line 6, right upper column, page 30 to line 11, right lower column, page 35; EP-A-355660, lines 15 to 27, page 4; line 30, page 5 to the last line, page 28; lines 29 to 31, page 45; and line 23, page 47 to line 50, page 63 are effectively used in the present invention.

Also, the compounds represented by formula (II) and (III) described in WO-98/33760 and the compound represented by formula (D) described in JP-A-10-221825 may be added.

These couplers are described further in detail below.

A cyan coupler which can preferably be used in the present invention is a pyrrolotriazole coupler, and the couplers represented by formula (I) or (II) in JP-A-5-313324, the coupler represented by formula (I) in JP-A-6-347960, and the couplers exemplified in these patents are particularly preferably used.

Phenol-based and naphthol-based cyan couplers are also preferably used in the present invention, e.g., the cyan coupler represented by formula (ADF) in JP-A-10-333297 is preferred.

Besides the above-described cyan couplers, the pyrroloazole type cyan couplers disclosed in EP 0488248 and EP-A-491197, the 2,5-diacylaminophenol couplers disclosed in U.S. Pat. No. 5,888,716, the pyrazoloazole type cyan couplers having an electron attractive group at the 6-position and a hydrogen bonding group disclosed in U.S. Pat. Nos. 4,873,183 and 4,916,051, in particular, the pyrazoloazole type cyan couplers having a carbamoyl group at the 6-position disclosed in JP-A-8-171185, JP-A-8-311360 and JP-A-8-339060 are also preferred.

In addition to the diphenylimidazole-based cyan couplers disclosed in JP-A-2-33144, the 3-hydroxypyridine-based cyan couplers disclosed in EP-A-0333185 (above all, Coupler (42), a 4-equivalent coupler is rendered 2-equivalent by having a chlorine releasing group, and Couplers (6) and (9), cited as specific examples, are particularly preferred), the cyclic active methylene-based cyan couplers disclosed in JP-A-64-32260 (above all, Couplers 3, 8 and 34 cited as specific examples are particularly preferred), the pyrrolopyrazole type cyan couplers disclosed in EP-A-0456226, and the pyrroloimidazole type cyan couplers disclosed in EP 0484909 can also be used as cyan couplers.

As the magenta couplers which are used in the present invention, the 5-pyrazolone-based magenta couplers and the pyrazoloazole-based magenta couplers disclosed in the above patents are preferably used, above all, in view of hue, image stability and a coloring property, the pyrazolotriazole couplers in which a secondary or tertiary alkyl group is directly bonded at the 2-, 3- or 6-position of the pyrazolotriazole ring disclosed in JP-A-61-65245, the pyrazoloazole couplers which contain a sulfonamido group in the molecule disclosed in JP-A-61-65246, the pyrazoloazole couplers which have an alkoxyphenylsulfonamido ballast group disclosed in JP-A-61-147254, and the pyrazoloazole couplers which have an alkoxy group or an aryloxy group at the 6-position disclosed in EP-A-226849 and EP-A-294785 are preferably used.

In particular, the pyrazoloazole coupler represented by formula (M-I) disclosed in JP-A-8-122984 is preferred, and the description in paragraphs 0009 to 0026 can be applied to the present invention in its entirety and can be used as a part of the specification of the present invention.

In addition, the pyrazoloazole couplers having steric hindrance groups at both of the 3- and 6-positions disclosed in EP 854384 and EP 884640 are also preferably used.

As the yellow couplers, in addition to the compounds disclosed in the above table, the acylacetamide type yellow couplers the acyl groups of which have 3- to 5-membered cyclic structures disclosed in EP-A-0447969, the malondianilide type yellow couplers having cyclic structures disclosed in EP-A-0482552, the acylacetamide type yellow couplers having dioxane structures disclosed in U.S. Pat. No. 5,118,599 are preferably used. Of these, the acylacetamide type yellow coupler in which the acyl group is a 1-alkyl-cyclopropane-1-carbonyl group and the malondianilide type yellow coupler in which one anilide constitutes an indoline ring are particularly preferably used. These couplers may be used alone or in combination.

It is preferred that the couplers for use in the present invention be impregnated with a loadable latex polymer (e.g., disclosed in U.S. Pat. No. 4,203,716) in the presence (or absence) of the high boiling point organic solvents described in the above table, or the couplers are dissolved in a polymer insoluble in water but soluble in an organic solvent and then dispersed in a hydrophilic colloidal aqueous solution in an emulsified state.

Examples of polymers insoluble in water but soluble in an organic solvent which can preferably be used in the present invention include the homopolymers and copolymers disclosed in U.S. Pat. No. 4,857,449, from columns 7 to 15, and WO 88/00723, pp. 12 to 30. Methacrylate-based or acrylamide-based polymers are preferred, in particular, acrylamide-based polymers are preferred in view of color image stability.

Well-known color mixing preventives can be used in the present invention, and the compounds disclosed in the following patents are particularly preferred.

For example, the high molecular weight redox compounds disclosed in JP-A-5-333501, the phenidone and hydrazine compounds disclosed in WO 98/33760 and U.S. Pat. No. 4,923,787, and the white couplers disclosed in JP-A-5-249637, JP-A-10-282615 and German Patent No. 19629142A1 can be used. Further, when rapid development is performed with increasing pH of a developing solution, the redox compounds disclosed in German Patent No. 19618786A1, EP-A-839623, EP-A-842975, German Patent 19806846A1 and French Patent 276046A1 are also preferably used.

It is preferred in the present invention to use a compound having a triazine skeleton having a high molar absorption coefficient as an ultraviolet absorber, and the following compounds can be used, for example.

The compounds disclosed in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent 19739797A, EP-A-711804 and JP-W-8-501291 can be used.

It is preferred to use gelatin as the binder or a protective colloid in the photographic material according to the present invention, but other hydrophilic colloids can be used alone or in combination with gelatin. As preferred gelatin, the content of heavy metals such as iron, copper, zinc, manganese, etc., which are contained as impurities is preferably 5 ppm or less, more preferably 3 ppm or less.

The amount of calcium contained in the photographic material is preferably 20 mg/m$^2$ or less, more preferably 10 mg/m$^2$ or less, and most preferably 5 mg/m$^2$ or less.

Fungicides and biocides disclosed in JP-A-63-271247 are preferably used in the present invention for preventing various kinds of molds and bacteria from proliferating in hydrophilic colloid layers and deteriorating images.

The pH of the layers of the photographic material is preferably from 4.0 to 7.0, more preferably from 4.0 to 6.5.

Surfactants can be added to photographic materials in the present invention for the purpose of improving coating stability, preventing the generation of static electricity and adjusting the quantity of electrostatic charge, etc. The examples of the surfactants which can be used include anionic, cationic, betaine and nonionic-based surfactants, e.g., those disclosed in JP-A-5-333492 can be exemplified. Fluorine-containing surfactants are especially preferably used in the present invention.

The addition amount of these surfactants is not particularly restricted and the amount is generally from $1\times10^{-5}$ to 1 g/m$^2$, preferably from $1\times10^{-4}$ to $1\times10^{-1}$ g/m$^2$, and more preferably from $1\times10^{-3}$ to $1\times10^{-2}$ g/m$^2$.

Fluorine-containing surfactants may be used alone or may be used in combination with conventionally well-known other surfactants, preferably with conventionally well-known other surfactants.

The photographic material of the present invention is also suitable for a scanning exposure system using a cathode ray tube (CRT) as well as printing systems using a general negative printer. A cathode ray tube exposure apparatus is simple and compact as compared with the apparatus using laser beams, costs can be saved and the adjustment of optical axis and color is easy.

Various emitters showing emission to spectral regions according to necessity are used in a cathode ray tube for use for image exposure. For example, any one of red emitter, green emitter and blue emitter, or mixture of two or more of these are used. Spectral regions are not limited to the above red, green and blue, and phosphors emitting lights in yellow, orange, violet and infrared regions are also used. A cathode ray tube which emits white light by mixing these emitters is often used.

When a photographic material has a plurality of photosensitive layers having different spectral sensitivity distributions and a cathode ray tube also has phosphors emitting lights in a plurality of spectral regions, a plurality of colors maybe exposed at the same time, i.e., image signals of a plurality of colors may be inputted to the cathode ray tube and emitted from the tube. Alternatively, an exposure method comprising inputting an image signal of each color in order and emitting light of each color in order through a filter cutting other colors except for that color (sequential exposure) may be adopted. In general, sequential exposure is preferred for obtaining a high quality image because a cathode ray tube having high resolving power can be used.

The photographic material of the present invention can be used in a digital scanning exposure system using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, at least one of exposure light sources should be a semiconductor laser.

When such a scanning exposure light source is used, the spectral sensitivity maximum wavelength of the photographic material of the present invention can be set arbitrarily according to the wavelength of the scanning exposure light source to be used. Since oscillation wavelength of a laser can be made half using an SHG light source comprising a combination of nonlinear optical crystal with a solid state laser using a semiconductor laser as an excitation light source or a semiconductor laser, blue light and green light can be obtained. Accordingly, it is possible to have the spectral sensitivity maximum of a photographic material in normal three regions of blue, green and red.

The exposure time in such a scanning exposure is defined as the time necessary to expose a pixel size with the pixel density being 400 dpi, and preferred exposure time is $10^{-4}$ sec or less and more preferably $10^{-6}$ sec or less.

Preferred scanning exposure systems which can be applied to the present invention are disclosed in detail in the patents described in the above table.

For processing the photographic material according to the present invention, processing substances and processing methods disclosed in JP-A-2-207250, line 1, right lower column, page 26 to line 9, right upper column, page 34; and JP-A-4-97355, line 17, left upper column, page 5 to line 20, right lower column, page 18 can be preferably used. Further, as preservatives for use in these developing solutions, compounds disclosed in the patents described in the above table can preferably be used.

The present invention is preferably applied to photographic materials having rapid processing suitability.

The color developing time according to the present invention is the time since a photographic material enters a color developing solution until it enters the subsequent blixing solution. For example, when a photographic material is processed in an automatic processor, the color developing time is the total of the time of a photographic material being immersed in a color developing solution (so-called time in the solution) and the time of coming out of the developing solution and being transferred to the subsequent blixing bath (so-called time in the air). Similarly, the blixing time is the time since a photographic material enters a blixing solution until it enters the subsequent washing or stabilizing bath. The washing or stabilizing time is the time since a photographic material enters a washing or stabilizing bath and in the solution before drying step (so-called time in the solution).

When rapid processing is performed, the color developing time according to the present invention is preferably 60 seconds or less, more preferably from 6 to 50 seconds, and still more preferably from 6 to 30 seconds. The blixing time is preferably 60 seconds or less, more preferably from 6 to 50 seconds, and still more preferably from 6 to 30 seconds. The washing or stabilizing time is preferably 150 seconds or less, more preferably from 6 to 130 seconds.

As the developing method of a photographic material of the present invention after exposure, a developing method (in a wet system) using a developing solution containing an alkali agent and a developing agent, a developing method (in a wet system) using an activator such as an alkali solution not containing a developing agent with a developing agent being incorporated in a photographic material, and a heat developing method not using a processing solution can be used. In particular, since an activator processing method does not contain a developing agent in a processing solution, management and handling of the solution are easy, further, the load of waste solution disposal is less, therefore, it is a preferred method from the standpoint of the environmental protection.

In an activator processing system, as the developing agent or the precursor thereof incorporated in a photographic material, the hydrazine compounds disclosed in JP-A-8-234388, JP-A-9-152686, JP-A-9-152693, JP-A-9-211814 and JP-A-9-160193 are preferably used.

Further, a developing method of image amplification (intensification processing) reducing the coating amount of silver amount and using hydrogen peroxide is also preferably used. It is particularly preferred to use this method in an activator processing system, e.g., image-forming methods using an activator containing hydrogen peroxide as disclosed in JP-A-8-297354 and JP-A-9-152695 are preferred.

In an activator processing method, a photographic material is ordinarily subjected to desilvering processing after being processed with an activator, but in the image amplifying processing using a low silver content photographic material, simple processing of performing washing or stabilization after activator processing without undergoing desilvering process can be effected. Further, in a system of reading out image data of a photographing material using a scanner, a processing mode which necessitates no desilvering processing can be adopted even when a high silver content photographic material such as a photographic material for photographing is used.

Well-known materials and processing methods can be used as the materials of the processing solutions of an activator solution, a desilvering solution (bleaching/blixing solution), a washing solution and a stabilizing solution for use in the present invention and processing methods. For example, those disclosed in *Research Disclosure,* Item 36544, pp. 536 to 541 (September, 1994) and JP-A-8-234388 are preferably used.

When the photographic material of the present invention is subjected to an exposure by printer, the band stop filter disclosed in U.S. Pat. No. 4,880,726 is preferably used. Using this filter, color mixing of light can be eliminated and color reproducibility is remarkably improved.

The photographic material of the present invention may be subjected to pre-exposure of yellow micro dot pattern to restrict printing before image data are given as disclosed in EP-A-0789270 and EP-A-0789480.

The photographic material according to the present invention can be preferably used in combination with the exposure and development systems in the following patents.

The automatic printer and the developing system disclosed in JP-A-10-333253.

The transporting apparatus of a photographic material disclosed in JP-A-2000-10206.

The recording system including an image reader disclosed in JP-A-11-215312.

The exposure systems comprising a color image-recording system disclosed in JP-A-11-88619 and JP-A-10-202950.

The digital photo print system including a remote diagnostic system disclosed in JP-A-10-210206.

The photo print system including an image-recording apparatus disclosed in Japanese Patent Application No. 10-159187.

EXAMPLE 1

Preparation of Emulsion A

Three point three (3.3) grams of sodium chloride was added to a 3% aqueous solution of lime-processed gelatin, and then 42.8 ml of 1N sulfuric acid and 25 ml of a 1% aqueous solution of 1,8-dihydroxy-3,6-dithiaoctane were added thereto. An aqueous solution containing 2.12 mol of silver nitrate and an aqueous solution containing 2.18 mol of sodium chloride were added to this aqueous solution with vigorously stirring at 68° C. The mixture was then precipitated and desalted by washing at 40° C. Further, 168.0 g of lime-processed gelatin was added to the emulsion and pH and pAg were adjusted to 5.6 and 7.3 respectively. From the electron microphotograph, the emulsion grains were revealed to be cubic and have an average grain size of 0.76 $\mu$m and a variation coefficient of 10%.

Preparation of Emulsion B

Emulsion B was prepared in the same manner as in the preparation of Emulsion A except that a silver iodide fine grain emulsion containing 0.004 mol of iodide ion was added to the reaction solution in the step of the addition of from 95 to 100% of the entire silver amount (surface shell of 5%) in emulsion grain formation. The silver iodide fine grain emulsion was prepared using the stirrer.

It was confirmed from the electron microphotograph that the shape of the obtained grains was a cubic form in which the peak of the grains was scarcely rounded.

Preparation of Emulsion C

Emulsion C was prepared in the same manner as in the preparation of Emulsion B except that the time of addition of the silver iodide fine grain emulsion containing 0.004 mol of iodide ion was changed to the step of the addition of from 91 to 96% of the entire silver amount. The shape of the obtained grains was the same as in Emulsion B.

Preparation of Emulsion D

Emulsion D was prepared in the same manner as in the preparation of Emulsion B except that the time of addition of the silver iodide fine grain emulsion containing 0.004 mol of iodide ion was changed to the step of the addition of from 85 to 90% of the entire silver amount. The shape of the obtained grains was the same as in Emulsion B.

Preparation of Emulsion E

Emulsion E was prepared in the same manner as in the preparation of Emulsion B except that the time of addition of the silver iodide fine grain emulsion containing 0.004 mol of iodide ion was changed to the step of the addition of from 80 to 85% of the entire silver amount. The shape of the obtained grains was the same as in Emulsion B.

Preparation of Emulsion F

Emulsion F was prepared in the same manner as in the preparation of Emulsion A except that an aqueous solution containing 0.004 mol of potassium iodide was added to the reaction solution in the step of the addition of from 95 to 96% of the entire silver amount in emulsion grain formation. It was confirmed from the electron microphotograph that the shape of the obtained grains was a cubic form in which the peak of the grains was scarcely rounded.

Preparation of Emulsion G

Emulsion G was prepared in the same manner as in the preparation of Emulsion A except that an aqueous solution containing 0.004 mol of potassium iodide was added to the reaction solution in the step of the addition of from 85 to 86% of the entire silver amount in emulsion grain formation. It was confirmed from the electron microphotograph that the shape of the obtained grains was a cubic form in which the peak of the grains was scarcely rounded.

Experiment 1

Measurement of the Distribution of the Content of Iodide Ion in a Grain

The distribution of an iodide in the depth direction of each silver halide grain of Emulsions B to G was measured according to an etching/TOF-SIMS method. The samples for the test were prepared as follows. After each emulsion was added to hot water and gelatin was dissolved, the grains and the gelatin were centrifuged and the precipitated grains were coated on an Si substrate. The coated sample was determined by an etching/TOF-SIMS method. The sample was refrigerated to −120° C. or less for preventing the damage due to irradiated gallium ion. The analysis area was 60 $\mu m^2$ and the etched area was 240 $\mu m^2$. The etching rate was evaluated with a silver chloride vapor-deposited film. The depth of about 0.5 to 1 nm was analyzed by one etching, and the depth of about 100 nm was analyzed by repeating etching. Secondary ion of iodide was analyzed by negative ion measurement mode. After etching/TOF-SIMS measurement of the iodide ion, the secondary ion of silver measurement was performed for a certain period of time by positive ion measurement mode, and the number of grains in the sample was compensated for by normalizing the secondary ion ($I^-$) strength of the iodide with the secondary ion ($Ag^+$) strength of the silver.

It can be seen from FIGS. 2 to 7 that iodide ions are present to the surface of the grain of the emulsion which finished the addition of iodide ions in the inside of the grain. The silver chloroiodide emulsion according to the present invention shows the distribution of the iodide ion content in the inside of the grain decreasing from the surface in the depth direction.

To each of the above Emulsions A to G were added a gold sensitizer (colloidal gold sulfide) in an amount of $6\times10^{-6}$ mol/mol-Ag and a blue-sensitive spectral sensitizing dye (A) (i.e., Sensitizing Dye A shown below) in an amount of $3.1\times10^{-4}$ mol/mol-Ag, and each emulsion was optimally chemically sensitized. Further, 1-(5-methylureidophenyl)-5-mercaptotetrazole was added to each emulsion in an amount of $4.4\times10^{-6}$ mol/mol-Ag, thereby Emulsions A' to G' were prepared.

The surface of a paper support laminated on both sides with a polyethylene resin was corona discharged. The support was provided with a gelatin undercoat layer containing sodium dodecylbenzenesulfonate and, further, the first to seventh photographic constitutional layers were coated in order on the undercoat layer to prepare silver halide color photographic material Sample No. 101 having the following composition. The coating solution of each photographic constitutional layer was prepared as follows.

Preparation of Coating Solution for First Layer

A yellow coupler (ExY) (57 g), 7 g of a color image stabilizer (Cpd-1), 4 g of a color image stabilizer (Cpd-2) 7 g of a color image stabilizer (Cpd-3), and 2 g of a color image stabilizer (Cpd-8) were dissolved in 21 g of a solvent (Solv-1) and 80 ml of ethyl acetate, this solution was emulsification-dispersed by means of a high velocity stirring emulsifier (dissolver) in 220 g of a 23.5 wt % aqueous gelatin solution containing 4 g of sodium dodecylbenzenesulfonate, and water was added thereto to obtain 900 g of Emulsified Dispersion A.

On the other hand, the above Emulsified Dispersions A and Emulsion A' were mixed and dissolved to prepare a coating solution for the first layer having the composition shown below. The coating amount of the emulsion was calculated in terms of silver.

The coating solutions for the second to seventh layers were prepared in the same manner as the coating solution for the first layer. 1-Oxy-3,5-dichloro-s-triazine sodium salt H-1, H-2 and H-3 were used as gelatin hardening agents in each layer. Further, Ab-1, Ab-2, Ab-3 and Ab-4 were added to each layer in an amount of 15.0 mg/m$^2$, 60.0 mg/m$^2$, 5.0 mg/M$^2$ and 10.0 mg/m$^2$ respectively.

Sensitizing Dye A

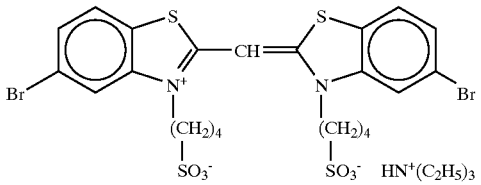

(H-1) Hardening Agent

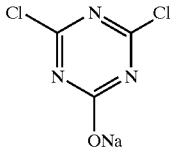

(1.4 wt % per gelatin)

(H-2) Hardening Agent

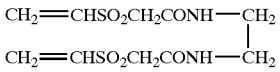

(H-3) Hardening Agent

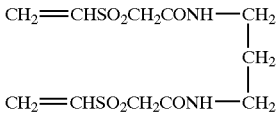

(Ab-1) Antiseptic

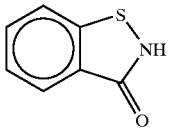

(Ab-2) Antiseptic

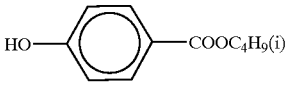

(Ab-3) Antiseptic

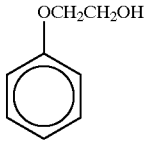

-continued (Ab-4)

A 1/1/1/1 mixture of a/b/c/d (molar ratio)

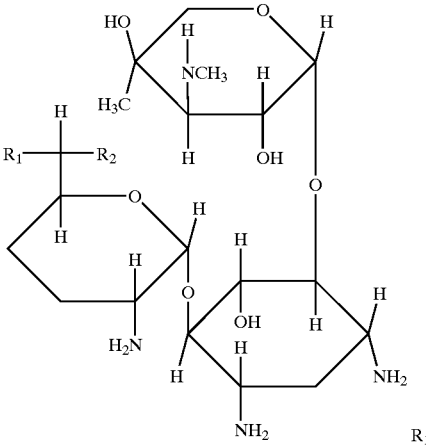

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

The following spectral sensitizing dyes were respectively added to the silver chlorobromide emulsions of the green-sensitive and red-sensitive emulsion layers.

Green-Sensitive Emulsion Layer:

Sensitizing Dye D

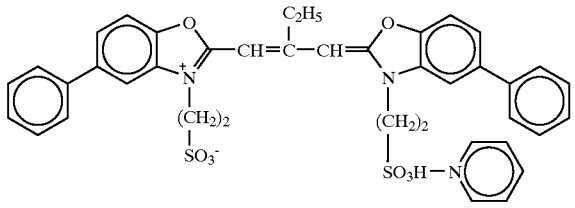

(in an amount of $3.0\times10^{-4}$ mol to the large grain size emulsion, and in an amount of $3.6\times10^{-4}$ mol to the small grain size emulsion each per mol of the silver halide)

Sensitizing Dye E

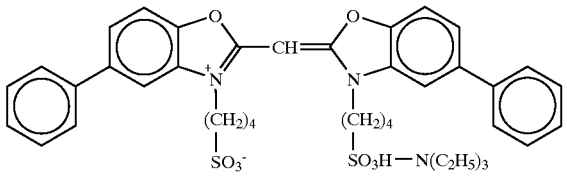

(in an amount of $4.0\times10^{-5}$ Mol to the large grain size emulsion, and in an amount of $7.0\times10^{-5}$ mol to the small grain size emulsion each per mol of the silver halide)

Sensitizing Dye F

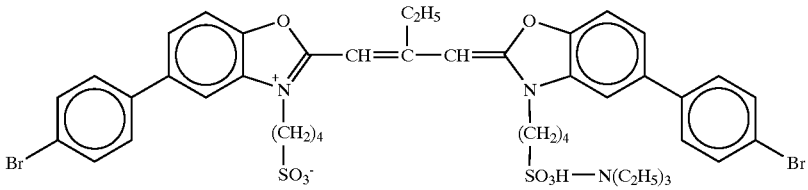

(in an amount of $2.0\times10^{-4}$ mol to the large grain size emulsion, and in an amount of $2.0\times10^{-4}$ mol to the small grain size emulsion each per mol of the silver halide)

Red-Sensitive Emulsion Layer:

Sensitizing Dye G

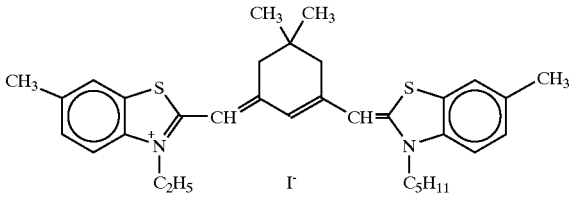

Sensitizing Dye H

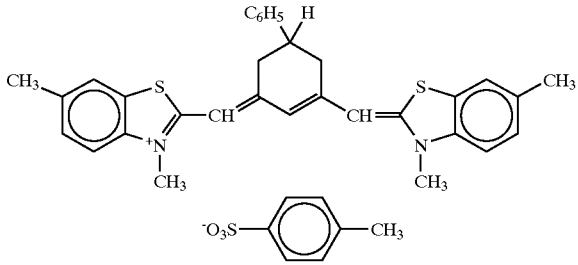

(each in an amount of $8.0\times10^{-5}$ mol to the large grain size emulsion, and each in an amount of $10.7\times10^{-5}$ mol to the small grain size emulsion each per mol of the silver halide)

Further, the following Compound I was added to the red-sensitive emulsion layer in an amount of $3.0\times10^{-3}$ mol per mol of the silver halide.

Compound I

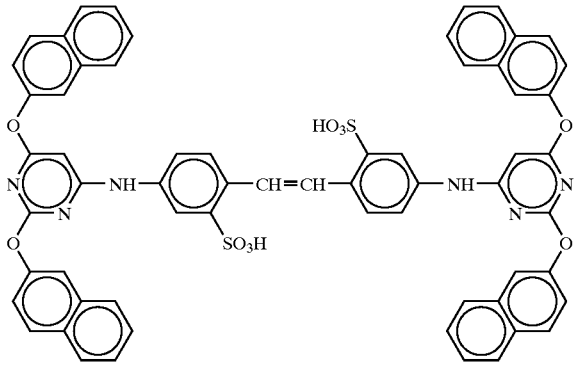

Further, 1-(3-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of the silver halide.

Further, 1-(3-methylureidophenyl)-5-mercaptotetrazole was also added to the second layer, the fourth layer, the sixth layer and the seventh layer in an amount of 0.2 mg/m$^2$, 0.2 mg/m$^2$, 0.6 mg/m$^2$ and 0.1 mg/m$^2$, respectively.

In addition, 4-hydroxy-6-methyl-1,3,3a,7-tetra-azaindene was added to the blue-sensitive emulsion layer and the green-sensitive emulsion layer in an amount of $1\times10^{-4}$ mol and $2\times10^{-4}$ mol, respectively, per mol of the silver halide.

Moreover, 0.05 g/m$^2$ of a copolymer latex of methacrylic acid and butyl acrylate (weight ratio: 1/1, average molecular weight: from 200,000 to 400,000) was added to the red-sensitive emulsion layer.

Further, disodium catechol-3,5-disulfonate was added to the second layer, the fourth layer and the sixth layer in an amount of 6 mg/m$^2$, 6 mg/m$^2$ and 18 mg/m$^2$ respectively.

The following dyes were added for the purpose of irradiation prevention (the numerals in parentheses represent the coating amount).

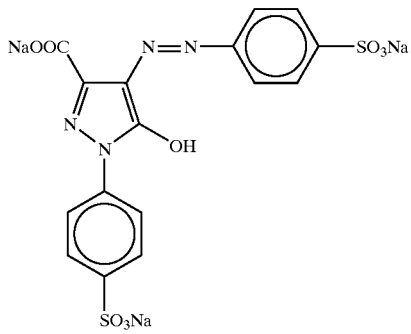

(2 mg/m$^2$)

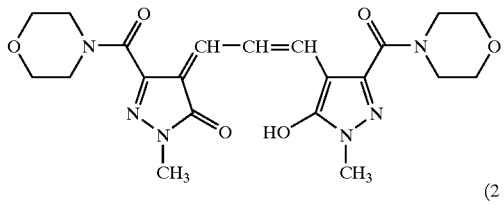

(2 mg/m$^2$)

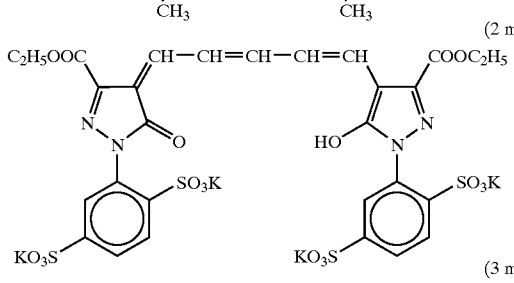

(3 mg/m$^2$)

-continued

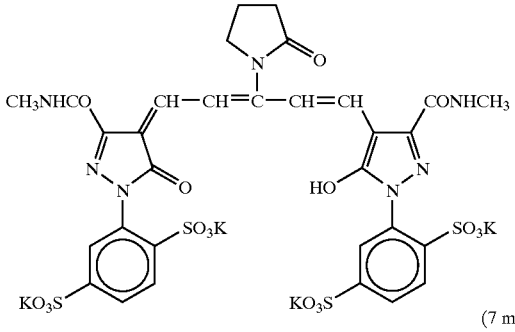

(7 mg/m$^2$)

Layer Constitution

The constitution of each layer is described below. The numeral represents the coating amount (g/m$^2$). The numeral for silver halide emulsion represents the coating amount in terms of silver.

Support

Polyethylene resin-laminated paper (a white pigment ($TiO_2$, content: 16 wt %, ZnO, content: 4 wt %), a brightening agent (4,4'-bis(5-methylbenzoxazolyl)stilbene, content: 0.03 wt %), and a blue dye (ultramarine) were added to the polyethylene resin of the first layer side).

| | |
|---|---|
| First Layer (blue-sensitive emulsion layer) | |
| Emulsion A | 0.24 |
| Gelatin | 1.25 |
| Yellow Coupler (ExY) | 0.57 |
| Color Image Stabilizer (Cpd-1) | 0.07 |
| Color Image Stabilizer (Cpd-2) | 0.04 |
| Color Image Stabilizer (Cpd-3) | 0.07 |
| Color Image Stabilizer (Cpd-8) | 0.02 |
| Solvent (Solv-1) | 0.21 |
| Second Layer (color mixture preventing layer) | |
| Gelatin | 0.99 |
| Color Mixing Preventive (Cpd-4) | 0.09 |
| Color Image Stabilizer (Cpd-5) | 0.018 |
| Color Image Stabilizer (Cpd-6) | 0.13 |
| Color Image Stabilizer (Cpd-7) | 0.01 |
| Solvent (Solv-1) | 0.06 |
| Solvent (Solv-2) | 0.22 |
| Third Layer (green-sensitive emulsion layer) | |
| Silver Chlorobromide Emulsion Em-1 | 0.14 |

(a gold-sulfur sensitized cubic form emulsion, a mixture in a ratio of 1/3 (silver mol ratio) of large grain size emulsion having an average grain size of 0.45 μm and small grain size emulsion having an average grain size of 0.35 μm; variation coefficients of the grain size distribution were 0.10 and 0.08 respectively, each size emulsion contained 0.15 mol % of silver iodide in the vicinity of the grain surface, and 0.4 mol % of silver bromide localized on the grain surface)

| | |
|---|---|
| Gelatin | 1.36 |
| Magenta Coupler (ExM) | 0.15 |
| Ultraviolet Absorber (UV-A) | 0.14 |
| Color Image Stabilizer (Cpd-2) | 0.02 |
| Color Image Stabilizer (Cpd-4) | 0.002 |
| Color Image Stabilizer (Cpd-6) | 0.09 |
| Color Image Stabilizer (Cpd-8) | 0.02 |
| Color Image Stabilizer (Cpd-9) | 0.03 |
| Color Image Stabilizer (Cpd-10) | 0.01 |

-continued

| | |
|---|---|
| Color Image Stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (color mixture preventing layer) | |
| Gelatin | 0.71 |
| Color Mixing Preventive (Cpd-4) | 0.06 |
| Color Image Stabilizer (Cpd-5) | 0.013 |
| Color Image Stabilizer (Cpd-6) | 0.10 |
| Color Image Stabilizer (Cpd-7) | 0.007 |
| Solvent (Solv-1) | 0.04 |
| Solvent (Solv-2) | 0.16 |
| Fifth Layer (red-sensitive emulsion layer) | |
| Silver Chlorobromide Emulsion Em-2 | 0.12 |

(a gold-sulfur sensitized cubic form emulsion, a mixture in a ratio of 5/5 (silver mol ratio) of large grain size emulsion having an average grain size of 0.40 μm and small grain size emulsion having an average grain size of 0.30 μm; variation coefficients of the grain size distribution were 0.09 and 0.11 respectively, each size emulsion contained 0.1 mol % of silver iodide in the vicinity of the grain surface, and 0.8 mol % of silver bromide localized on the grain surface)

| | |
|---|---|
| Gelatin | 1.11 |
| Cyan Coupler (ExC-2) | 0.13 |
| Cyan Coupler (ExC-3) | 0.03 |
| Color Image Stabilizer (Cpd-1) | 0.05 |
| Color Image Stabilizer (Cpd-6) | 0.06 |
| Color Image Stabilizer (Cpd-7) | 0.02 |
| Color Image Stabilizer (Cpd-9) | 0.04 |
| Color Image Stabilizer (Cpd-10) | 0.01 |
| Color Image Stabilizer (Cpd-14) | 0.01 |
| Color Image Stabilizer (Cpd-15) | 0.12 |
| Color Image Stabilizer (Cpd-16) | 0.03 |
| Color Image Stabilizer (Cpd-17) | 0.09 |
| Color Image Stabilizer (Cpd-18) | 0.07 |
| Solvent (Solv-5) | 0.15 |
| Solvent (Solv-8) | 0.05 |
| Sixth Layer (ultraviolet absorbing layer) | |
| Gelatin | 0.46 |
| Ultraviolet Absorber (UV-B) | 0.45 |
| Compound (S1-4) | 0.0015 |
| Solvent (Solv-7) | 0.25 |
| Seventh Layer (protective layer) | |
| Gelatin | 1.00 |
| Acryl-Modified Copolymer of Polyvinyl Alcohol (modification degree: 17%) | 0.04 |
| Liquid Paraffin | 0.02 |
| Surfactant (Cpd-13) | 0.01 |

(ExY) Yellow Coupler

A 70/30 mixture by mol ratio of

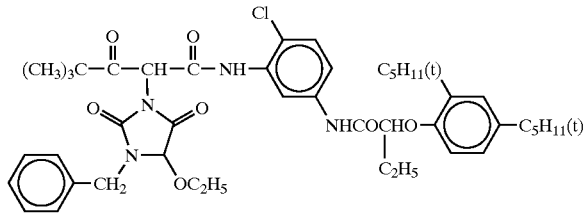

and

-continued
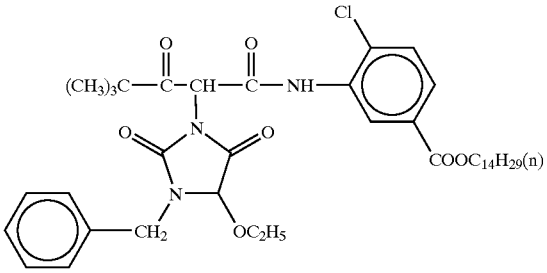
(ExM) Magenta Coupler
A 40/40/20 mixture by mol ratio of
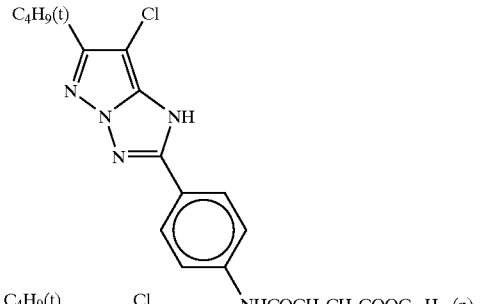
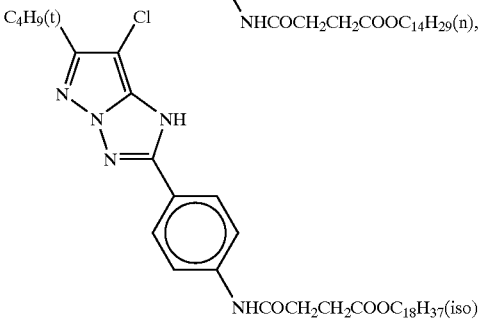
and
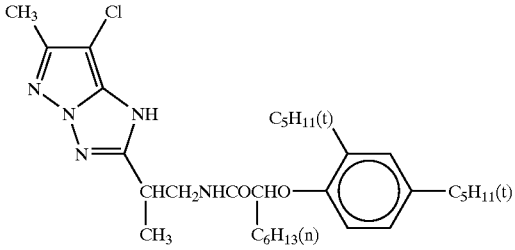
(ExC-2) Cyan Coupler
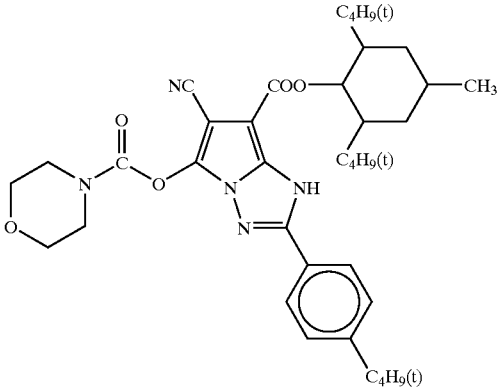
-continued
(ExC-3) Cyan Coupler
A 50/25/25 mixture by mol ratio of
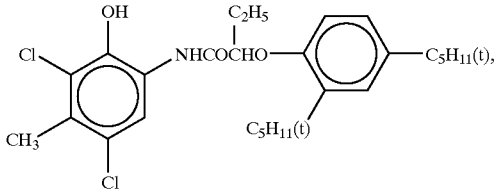
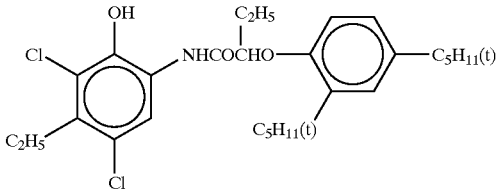
and
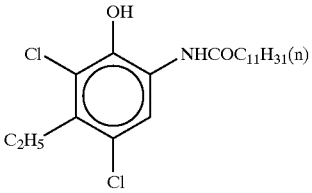
(Cpd-1) Color Image Stabilizer
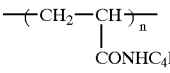
average molecular weight: 60,000
(Cpd-2) Color Image Stabilizer
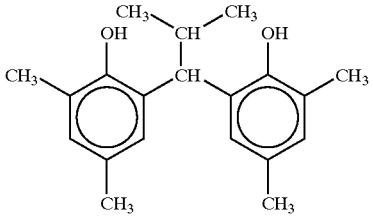
(Cpd-3) Color Image Stabilizer
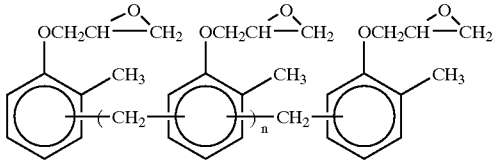
n = 7 to 8 (average value)
(Cpd-4) Color Mixing Preventive
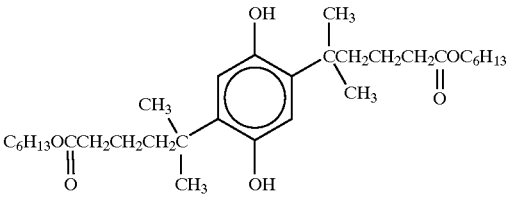

-continued
(Cpd-5) Color Image Stabilizer
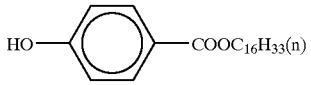
(Cpd-6) Color Image Stabilizer
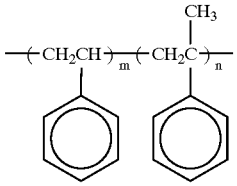
number average molecular weight; 600, m/n = 10/90
(Cpd-7) Color Image Stabilizer
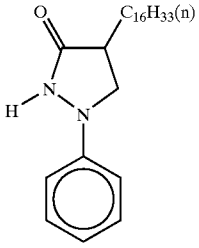
(Cpd-8) Color Image Stabilizer
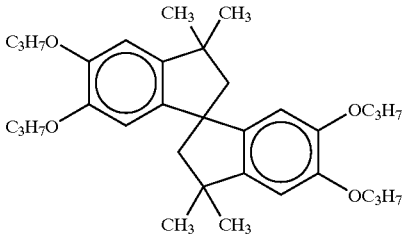
(Cpd-9) Color Image Stabilizer
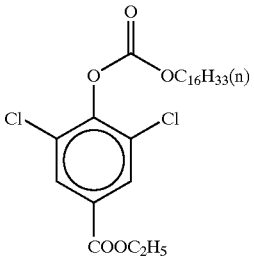
(Cpd-10) Color Image Stabilizer
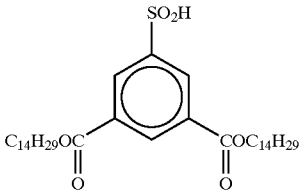
-continued
(Cpd-11) Color Image Stabilizer
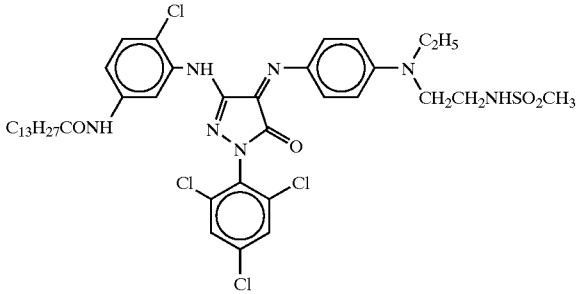
(Cpd-13) Surfactant
A 7/3 mixture by mol ratio of
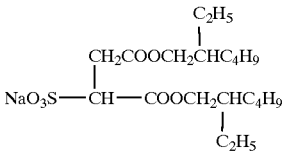
and
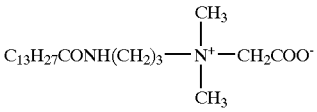
(Cpd-14)
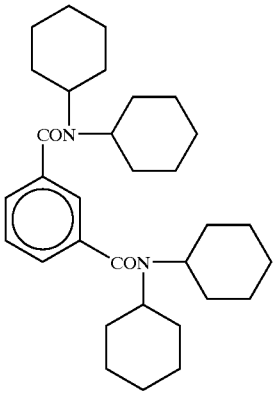
(Cpd-15)
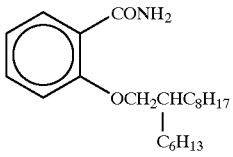
(Cpd-16)
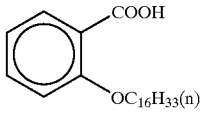

-continued (Cpd-17)

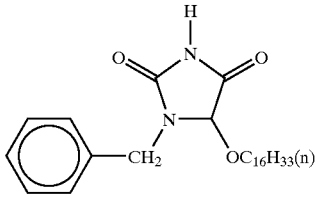

(Cpd-18)

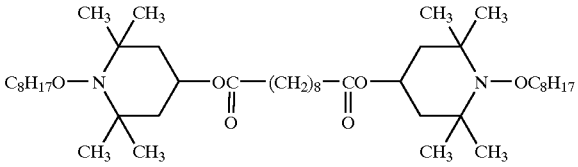

(Cpd-19) Color Mixing Preventive

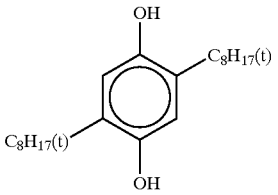

(UV-1) UV Absorber

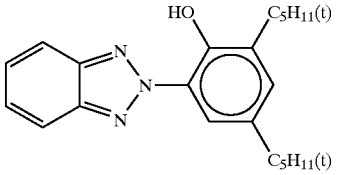

(UV-2) UV Absorber

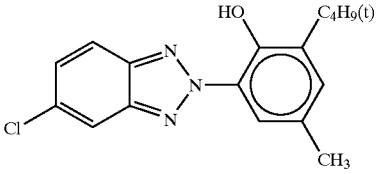

(UV-3) UV Absorber

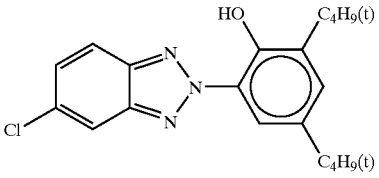

(UV-4) UV Absorber

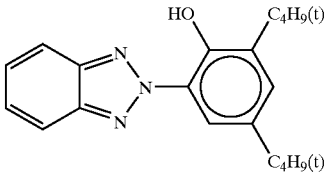

-continued (UV-5) UV Absorber

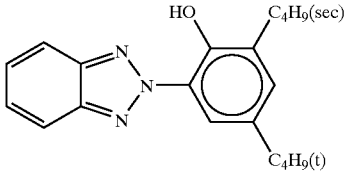

(UV-6) UV Absorber

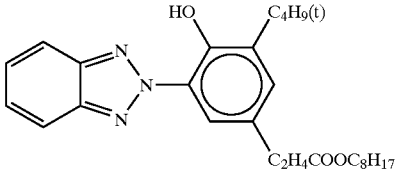

(UV-7) UV Absorber

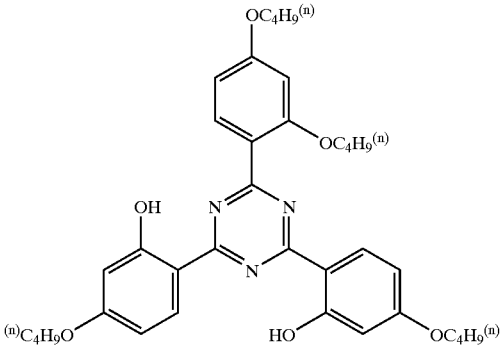

UV-A

A 4/2/2/3 mixture of Uv-1/UV-2/UV-3/UV-4 (by weight)

UV-B

A 9/3/3/4/5/3 mixture of UV-1/UV-2/UV-3/UV-4/UV-5/UV-6 (by weight)

UV-C

A 1/1/1/2 mixture of UV-2/UV-3/UV-6/UV-7 (by weight)

(Solv-1) Solvent

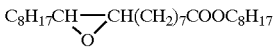

(Solv-2) Solvent

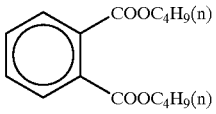

(Solv-3) Solvent

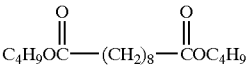

(Solv-4) Solvent

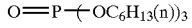

(Solv-5) Solvent

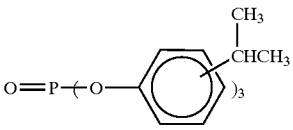

-continued (Solv-7) Solvent

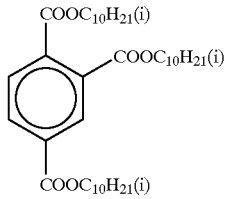

(Solv-8) Solvent

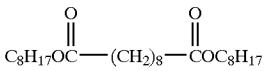

S1-4

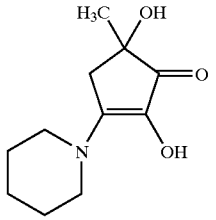

Sample Nos. 102 to 107 were prepared in the same manner as in the preparation of Sample No. 101 except that Emulsion A' was replaced with Emulsions B', C', D', E', F' and G' respectively.

For examining photographic characteristics, the following experiment was performed.

Experiment 2

Sensitometry

Each sample was subjected to gradation exposure for sensitometry using a sensitometer (model FWH manufactured by Fuji Photo Film Co., Ltd.), through an SP-1 filter by low intensity illuminance for 10 seconds.

Further, each sample was subjected to gradation exposure for sensitometry using a sensitometer for high intensity illuminance exposure (model HIE manufactured by Yamashita Denso Co., Ltd.), through an SP-1 filter by high intensity illuminance for $10^{-4}$ seconds.

After exposure, each sample was processed according to the following color development process A.

The processing step was as follows.

Process A

Sample No. 101 was processed to a roll of 127 mm width and subjected to imagewise exposure and continuous processing (running test) with a mini-labo printer processor PP1258AR (manufactured by Fuji Photo Film Co., Ltd.) by the following processing step until the color developing replenisher was replenished two times the amount of the color developing tank capacity. The processing using this running solution was taken as process A.

| Processing Step | Processing Temperature (° C.) | Processing Time (sec) | Replenishment Rate* (ml) |
|---|---|---|---|
| Color Development | 38.5 | 45 | 45 |
| Blixing | 38.0 | 45 | 35 |
| Rinsing (1) | 38.0 | 20 | — |

-continued

| Processing Step | Processing Temperature (° C.) | Processing Time (sec) | Replenishment Rate* (ml) |
|---|---|---|---|
| Rinsing (2) | 38.0 | 20 | — |
| Rinsing (3)** | 38.0 | 20 | — |
| Rinsing (4)** | 38.0 | 30 | 121 |

*Replenishment rate per $m^2$ of the photographic material

**Rinse cleaning system RC50D (reverse osmosis membrane module, a product of Fuji Photo Film Co., Ltd.) was installed in rinsing tank (3), the rinsing solution in tank (3) was taken out, and the solution taken out was supplied to RC50D by a pump. The permeated solution obtained from this tank was supplied to rinsing tank (4) and the concentrated solution was returned back to rinsing tank (3). The pressure of the pump was adjusted to maintain the permeation rate of the solution of from 50 to 300 ml/min. to the reverse osmosis membrane module, and the system was circulated for 10 hours a day with controlling temperature. (Rinsing was a 4-tank countercurrent system from rinsing (4) to rinsing (1).)

The composition of each processing solution used is described below.

| | Tank Solution | Replenisher |
|---|---|---|
| Color Developing Solution | | |
| Water | 800 ml | 800 ml |
| Dimethylpolysiloxane Surfactant (Silicone KF351A, a product of Shin-Etsu Chemical Co., Ltd.) | 0.1 g | 0.1 g |
| Tri (isopropanol) amine | 8.8 g | 8.8 g |
| Ethylenediaminetetraacetic Acid | 4.0 g | 4.0 g |
| Polyethylene Glycol (molecular weight: 300) | 10.0 g | 10.0 g |
| Sodium 4,5-Dihydroxybenzene-1,3-disulfonate | 0.5 g | 0.5 g |
| Potassium Chloride | 10.0 g | — |
| Potassium Bromide | 0.040 g | 0.010 g |
| Triazinylaminostilbene-Based Brightening Agent (Hakkol FWA-SF, a product of Showa Kagaku Co., Ltd.) | 2.5 g | 5.0 g |
| Sodium Sulfite | 0.1 g | 0.1 g |
| Disodium-N,N-bis(sulfonato-ethyl)hydroxylamine | 8.5 g | 11.1 g |
| N-Ethyl-N-(β-methanesulfon-amidoethyl)-3-methyl-4-amino-4-aminoaniline.3/2 Sulfate. Monohydrate | 5.0 g | 15.7 g |
| Potassium Carbonate | 26.3 g | 26.3 g |
| Water to make | 1,000 ml | 1,000 ml |
| pH (25° C., adjusted with potassium hydroxide and sulfuric acid) | 10.15 | 12.50 |
| Blixing Solution | | |
| Water | 700 ml | 600 ml |
| Ammonium Ethylenediamine-tetraacetato Ferrate (III) | 47.0 g | 94.0 g |
| Ethylenediaminetetraacetic Acid | 1.4 g | 2.8 g |
| m-Carboxybenzenesulfinic Acid | 8.3 g | 16.5 g |
| Nitric Acid (67%) | 16.5 g | 33.0 g |
| Imidazole | 14.6 g | 29.2 g |
| Ammonium Thiosulfate (750 g/liter) | 107.0 ml | 214.0 ml |
| Ammonium Sulfite | 16.0 g | 32.0 g |
| Ammonium Bisulfite | 23.1 g | 46.2 g |
| Water to make | 1,000 ml | 1,000 ml |
| pH (25° C., adjusted with acetic acid and ammonia) | 6.0 | 6.0 |
| Rinsing Solution | | |
| Sodium Chlorinated Isocyanurate | 0.02 g | 0.02 g |
| Deionized water (electric conductivity: 5 μs/cm or less) | 1,000 ml | 1,000 ml |
| pH | 6.5 | 6.5 |

Yellow density of each sample after processing was measured, and fog density of each of Emulsions A' to G, low intensity illuminance sensitivity of 10 sec. and high intensity illuminance sensitivity of $10^{-4}$ sec. were obtained. The sensitivity is the reciprocal of the exposure amount giving the color density of the minimum density+1.0 and expressed as relative sensitivity with the sensitivity of Sample No. 101 development processed being taken as 100. The results obtained are shown in Table 3.

TABLE 3

| Sample No. | Emulsion | Fog Density | Low Intensity Illuminance Sensitivity | High Intensity Illuminance Sensitivity |
|---|---|---|---|---|
| 101 | A' (Comparison) | 0.07 | 100 | 100 |
| 102 | B' (Invention) | 0.10 | 200 | 220 |
| 103 | C' (Invention) | 0.07 | 190 | 214 |
| 104 | D' (Invention) | 0.07 | 170 | 195 |
| 105 | E' (Comparison) | 0.07 | 120 | 135 |
| 106 | F' (Invention) | 0.08 | 195 | 216 |
| 107 | G' (Invention) | 0.07 | 150 | 170 |

It can be seen from the results in Table 1 and FIGS. 2 to 7 that the silver chloroiodide emulsions according to the present invention show higher sensitivity and are excellent in high intensity reciprocity characteristic due to the distribution of the iodide ion content in the inside of the grain decreasing from the surface in the depth direction. Further, the emulsions according to the present invention which have finished the addition of iodide ions before 98% of the grains are formed show that they are low in generation of fog and have high sensitivity. FIGS. 2 to 7 show the above distribution of Emulsions B to G respectively.

EXAMPLE 2

Preparation of Emulsion H

Five point six (5.6) grams of sodium chloride was added to a 5% aqueous solution of lime-processed gelatin, and then 42.8 ml of 1N sulfuric acid and 1.1 ml of a 1% aqueous solution of N,N'-dimethylimidazolidine-2-thione were added thereto. An aqueous solution containing 0.21 mol of silver nitrate and an aqueous solution containing 0.21 mol of sodium chloride were added to the above aqueous solution with stirring at 61° C. While maintaining the temperature at 61° C., an aqueous solution containing 1.27 mol of silver nitrate, and an aqueous solution containing 1.27 mol of sodium chloride and $1\times10^{-8}$ mol per entire silver amount of a transition metal complex of $K_2[Ru(NO)Cl_5]$ were added with stirring and mixed with the above solution, further an aqueous solution containing 0.21 mol of silver nitrate and an aqueous solution containing 0.21 mol of sodium chloride were added with stirring and mixed with the above solution, still further an aqueous solution containing 0.21 mol of silver nitrate, and an aqueous solution containing 0.21 mol of sodium chloride and $2\times10^{-5}$ mol per entire silver amount of a transition metal complex of $K_4[Ru(CN)_5]$ were added with stirring and mixed with the above solution. Further, with maintaining the temperature at 61° C., an aqueous solution containing 0.02 mol of silver nitrate and an aqueous solution containing 0.02 mol of sodium chloride were added with stirring and mixed with the above solution. Subsequently, an aqueous solution containing 0.11 mol of silver nitrate, and an aqueous solution containing 0.11 mol of sodium chloride and $2\times10^{-6}$ mol per entire silver amount of a transition metal complex of $K_2[Ir(H_2O)Cl_5]$ were added with stirring and mixed with the above solution, further an aqueous solution containing 0.04 mol of silver nitrate, and an aqueous solution containing 0.04 mol of sodium chloride and $4\times10^{-8}$ mol per entire silver amount of a transition metal complex of $K_2[IrCl_6]$ were added with stirring and mixed with the above solution, and an aqueous solution containing 0.04 mol of silver nitrate and an aqueous solution containing 0.04 mol of sodium chloride were added with stirring and mixed with the above solution at 61° C. The mixed solution was then precipitated and desalted by washing at 40° C. Further, 168.0 g of lime-processed gelatin was added to the above emulsion and pH and pAg were adjusted to 5.6 and 7.3 respectively. From the electron microphotograph, the emulsion grains were revealed to be cubic and have an average grain size of 0.62 $\mu$m and a variation coefficient of 10%.

To the emulsion were added a gold sensitizer (gold (I) tetrafluoroborate bis(1,4,5-trimethyl-1,2,4-triazolium-3-thiolato)) in an amount of $1.5\times10^{-5}$ mol/mol-Ag, a sulfur sensitizer (sodium thiosulfate) in an amount of $6\times10^{-7}$ mol/mol-Ag, blue-sensitive spectral sensitizing dyes (Sensitizing Dyes A and B) in amounts of $2.3\times10^{-4}$ mol/mol-Ag and $1.5\times10^{-4}$ mol/mol-Ag respectively, and the emulsion was optimally chemically and spectrally sensitized at 60° C. Further, 1-(5-methylureidophenyl)-5-mercaptotetrazole was added to the emulsion in an amount of $4.4\times10^{-4}$ mol/mol-Ag.

Sensitizing Dye A

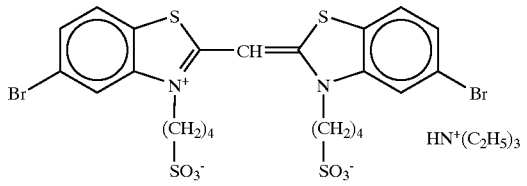

Sensitizing Dye B

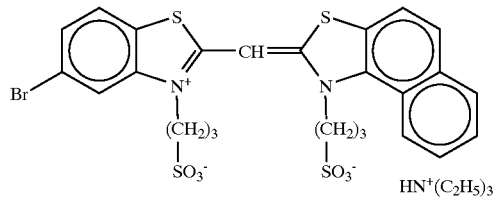

Preparation of Emulsion J

Emulsion J was prepared according to the same method as in the preparation of Emulsion H except that an aqueous solution containing 0.006 mol of potassium iodide was added when from 90 to 91% of the entire silver amount was added in emulsion grain formation. It was confirmed from the electron microphotograph that the shape of the obtained grains was a cubic form in which the peak of the grains was scarcely rounded.

Preparation of Emulsion K

Emulsion K was prepared according to the same method as in the preparation of Emulsion J except that a transition metal complex of $K_2[IrCl_6]$ was not added. The shape of the obtained grains was the same as in Emulsion J.

Preparation of Emulsion Q

Emulsion Q was prepared according to the same method as in the preparation of Emulsion H except that a silver iodide fine grain emulsion containing 0.006 mol of iodide ion was added when from 90 to 95% of the entire silver amount was added in emulsion grain formation and a transition metal complex of $K_2[Ir(H_2O)Cl_5]$ was changed to $K_2[Ir(5\text{-methylthiazole})Cl_5]$.

The preparation of the silver iodide fine grains emulsion was carried out using the stirrer (i.e., the stirring mixer) described in JP-A-10-43570.

It was confirmed from the electron microphotograph that the shape of the obtained grains was a cubic form in which the peak of the grains was scarcely rounded.

Preparation of Emulsion R

Emulsion R was prepared according to the same method as in the preparation of Emulsion Q except that in the step of chemical sensitization, the blue-spectral sensitizing dye was changed to Sensitizing Dye C shown below. The shape of the obtained grains was the same as in Emulsion P.

Sensitizing Dye C

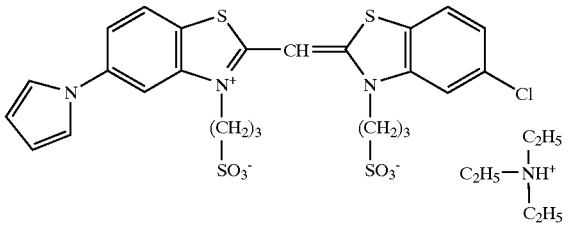

As a result of performing Experiment 1 in Example 1 using the above Emulsions J, K, Q and R, the emulsions showed the distribution of the iodide ion content in the inside of the grains decreasing from the surface in the depth direction, similarly to the emulsions according to the present invention in Example 1.

Sample Nos. 201 to 205 were produced with the same layer constitution as in Example 1 except that the emulsion in the first layer was replaced with Emulsions H to K, Q and R respectively. Experiment 2 in Example 1 and the following Experiment 3 were performed with these samples.

Experiment 3

Stability of Latent Image After Exposure

Sensitometry of each sample was measured with varying the time from after the above-described high intensity illuminance exposure of $10^{-4}$ second to process A, and the difference of sensitivity between processing after 60 minutes and processing after 7 seconds of each sample was obtained. The results obtained from these experiments are shown in Table 4 below.

TABLE 4

| Sample No. | Emulsion | Fog Density | Low Intensity Illuminance Sensitivity | High Intensity Illuminance Sensitivity | Sensitivity Difference Between Processing after 60 Min. and after 7 Sec. |
|---|---|---|---|---|---|
| 201 | H (Comparison) | 0.07 | 100 | 100 | 25 |
| 202 | J (Invention) | 0.07 | 240 | 260 | 5 |
| 203 | K (Invention) | 0.07 | 235 | 235 | 10 |
| 204 | Q (Invention) | 0.07 | 232 | 255 | 5 |
| 205 | R (Invention) | 0.07 | 240 | 263 | 5 |

From the results in Table 4, it can be seen that the silver chloroiodide emulsions according to the present invention are emulsions showing high sensitivity and low fog, and they are excellent in latent image stability after exposure.

EXAMPLE 3

Preparation of Emulsion L

Emulsion L was prepared in the same manner as in the preparation of Emulsion H in Example 2 except that a 1% aqueous solution of N,N'-dimethylimidazolidine-2-thione was not used. From the electron microphotograph, the emulsion grains were revealed to be cubic and have an average grain size of 0.38 $\mu$m and a variation coefficient of 8%.

To the emulsion were added a gold sensitizer (gold (I) tetrafluoroborate 4,5-trimethyl-1,2,4-triazolium-3-thiolato)) in an amount of $2.4\times10^{-5}$ mol/mol-Ag, a sulfur sensitizer (sodium thiosulfate) in an amount of $1\times10^{-7}$ mol/mol-Ag, green-sensitive spectral sensitizing dyes (Sensitizing Dyes D, E and F) in amounts of $3.6\times10^{-4}$ mol/mol-Ag, $7.0\times10^{-5}$ mol/mol-Ag and $2.8\times10^{-4}$ mol/mol-Ag respectively, and the emulsion was optimally chemically and spectrally sensitized at 60° C. Further, 1-(5-methylureidophenyl)-5-mercaptotetrazole was added to the emulsion in an amount of $4.4\times10^{-4}$ mol/mol-Ag.

Preparation of Emulsion M

Emulsion M was prepared according to the same method as in the preparation of Emulsion L except that an aqueous solution containing 0.002 mol of potassium iodide was added when from 90 to 91% of the entire silver amount was added in emulsion grain formation. It was confirmed from the electron microphotograph that the shape of the obtained grains was a cubic form in which the peak of the grains was scarcely rounded.

Preparation of Emulsion N

Emulsion N was prepared according to the same method as in the preparation of Emulsion M except that a transition metal complex of $K_2[IrCl_6]$ was not added. The shape of the obtained grains was the same as in Emulsion M.

Preparation of Emulsion P

Emulsion P was prepared according to the same method as in the preparation of Emulsion L except that a silver iodide fine grains emulsion containing 0.002 mol of iodide ion was added when from 90 to 95% of the entire silver amount was added in emulsion grain formation.

The preparation of silver iodide fine grain was carried out using the stirrer (i.e., the stirring mixer) described in JP-A-10-43570.

It was confirmed from the electron microphotograph that the shape of the obtained grains was a cubic form in which the peak of the grains was scarcely rounded.

As a result of performing Experiment 1 in Example 1 using the above Emulsions M, N and P, the emulsions showed the distribution of the iodide ion content in the inside of the grains decreasing from the surface in the depth direction, similarly to the emulsions according to the present invention in Example 1.

Sample Nos. 301 to 304 were produced with the same layer constitution as in Example 2 except that the green-sensitive emulsion Em-1 in the third layer was replaced with Emulsions L, M, N and P respectively. Each of these samples was processed in the same manner as in Example 2, magenta color density of each sample after processing was measured, and Experiments 2 and 3 in Example 2 were performed. The results of evaluations of these experiments are shown in Table 5 below.

TABLE 5

| Sample No. | Emulsion | Fog Density | Low Intensity Illuminance Sensitivity | High Intensity Illuminance Sensitivity | Sensitivity Difference Between Processing after 60 Min. and after 7 Sec. |
|---|---|---|---|---|---|
| 301 | L (Comparison) | 0.07 | 100 | 100 | 22 |
| 302 | M (Invention) | 0.07 | 189 | 202 | 4 |
| 303 | N (Invention) | 0.07 | 179 | 185 | 8 |
| 304 | P (Invention) | 0.07 | 180 | 200 | 4 |

From the results in Table 5, it can be seen that the silver chloroiodide emulsions according to the present invention are emulsions showing high sensitivity and low fog, and they are excellent in latent image stability after exposure.

EXAMPLE 4

Thin layered samples having the following layer constitutions were prepared and Experiments 2 and 3 in Example 1 were performed.

The layer constitution is shown in Sample No. 401. Samples 402 to 405 were the same as Sample No. 401 in which Emulsion H was replaced with Emulsions J, K, Q and R respectively.

The same results as in Example 1 were obtained from the above experiments. From these results, the effect of the present invention was confirmed also in super rapid processing of a thin layered sample.

| Preparation of Sample No. 401 | |
|---|---|
| First Layer (blue-sensitive emulsion layer) | |
| Emulsion H | 0.24 |
| Gelatin | 1.25 |
| Yellow Coupler (ExY) | 0.57 |
| Color Image Stabilizer (Cpd-1) | 0.07 |
| Color Image Stabilizer (Cpd-2) | 0.04 |
| Color Image Stabilizer (Cpd-3) | 0.07 |
| Color Image Stabilizer (Cpd-8) | 0.02 |
| Solvent (Solv-1) | 0.21 |
| Second Layer (color mixture preventing layer) | |
| Gelatin | 0.60 |
| Color Mixing Preventive (Cpd-19) | 0.09 |
| Color Image Stabilizer (Cpd-5) | 0.007 |
| Color Image Stabilizer (Cpd-7) | 0.007 |
| Ultraviolet Absorber (UV-C) | 0.05 |
| Solvent (Solv-5) | 0.11 |
| Third Layer (green-sensitive emulsion layer) | |
| Silver Chlorobromide Emulsion B (the same emulsion as in Sample No. 101) | 0.14 |
| Gelatin | 0.73 |
| Magenta Coupler (ExM) | 0.15 |
| Ultraviolet Absorber (UV-A) | 0.05 |
| Color Image Stabilizer (Cpd-2) | 0.02 |
| Color Image Stabilizer (Cpd-7) | 0.008 |
| Color Image Stabilizer (Cpd-8) | 0.07 |
| Color Image Stabilizer (Cpd-9) | 0.03 |
| Color Image Stabilizer (Cpd-10) | 0.009 |
| Color Image Stabilizer (Cpd-11) | 0.0001 |
| Solvent (Solv-3) | 0.06 |
| Solvent (Solv-4) | 0.11 |
| Solvent (Solv-5) | 0.06 |
| Fourth Layer (color mixture preventing layer) | |
| Gelatin | 0.48 |
| Color Mixing Preventive (Cpd-4) | 0.07 |
| Color Image Stabilizer (Cpd-5) | 0.006 |
| Color Image Stabilizer (Cpd-7) | 0.006 |

-continued

| Preparation of Sample No. 401 | |
|---|---|
| Ultraviolet Absorber (UV-C) | 0.04 |
| Solvent (Solv-5) | 0.09 |
| Fifth Layer (red-sensitive emulsion layer) | |
| Silver Chlorobromide Emulsion C (the same emulsion as in Sample No. 101) | 0.12 |
| Gelatin | 0.59 |
| Cyan Coupler (ExC-2) | 0.13 |
| Cyan Coupler (ExC-3) | 0.03 |
| Color Image Stabilizer (Cpd-7) | 0.01 |
| Color Image Stabilizer (Cpd-9) | 0.04 |
| Color Image Stabilizer (Cpd-15) | 0.19 |
| Color Image Stabilizer (Cpd-18) | 0.04 |
| Ultraviolet Absorber (UV-7) | 0.02 |
| Solvent (Solv-5) | 0.09 |
| Sixth Layer (ultraviolet absorbing layer) | |
| Gelatin | 0.32 |
| Ultraviolet Absorber (UV-C) | 0.42 |
| Solvent (Solv-7) | 0.08 |
| Seventh Layer (protective layer) | |
| Gelatin | 0.70 |
| Acryl-Modified Copolymer of Polyvinyl Alcohol (modification degree: 17%) | 0.04 |
| Liquid Paraffin | 0.01 |
| Surfactant (Cpd-13) | 0.01 |
| Polydimethyl siloxane | 0.01 |
| Silicon Dioxide | 0.003 |

Each sample produced above was exposed in the same manner as in Experiments 2 and 3 in Example 1, and color development-processed by super rapid processing according to process B shown below.

Process B

Each sample was processed to a roll of 127 mm width and subjected to imagewise exposure from a negative film having average density and then continuous processing (running test) with a mini-labo printer processor PP350 (manufactured by Fuji Photo Film Co., Ltd.) until the color developing replenisher was replenished 0.5 time the amount of the color developing tank capacity. Processor PP350 was modified for experiment so as to be able to arbitrarily change the processing time and processing temperature.

| Processing Step | Processing Temperature (° C.) | Processing Time (sec) | Replenishment Rate* (ml) |
|---|---|---|---|
| Color Development | 45.0 | 15 | 45 |
| Blixing | 40.0 | 15 | 35 |
| Rinsing (1) | 40.0 | 8 | — |
| Rinsing (2) | 40.0 | 8 | — |
| Rinsing (3)** | 40.0 | 8 | — |

-continued

| Processing Step | Processing Temperature (° C.) | Processing Time (sec) | Replenishment Rate* (ml) |
|---|---|---|---|
| Rinsing (4)** | 38.0 | 8 | 121 |
| Drying | 80 | 15 | |

*Replenishment rate per $m^2$ of the photographic material
**Rinse cleaning system RC50D (reverse osmosis membrane module, a product of Fuji Photo Film Co., Ltd.) was installed in rinsing tank (3), the rinsing solution in tank (3) was taken out, and the solution taken was supplied to RC50D by a pump. The permeated solution obtained from this tank was supplied to rinsing tank (4) and the concentrated solution was returned back to rinsing tank (3). The pressure of the pump was adjusted to maintain the permeation rate of the solution of from 50 to 300 ml/min. to the reverse osmosis membrane module, and the system was circulated for 10 hours a day with controlling temperature. Rinsing was a 4-tank countercurrent system from rinsing (4) to rinsing (1).

The composition of each processing solution used is described below.

| | Tank Solution | Replenisher |
|---|---|---|
| Color Developing Solution | | |
| Water | 800 ml | 600 ml |
| Brightening Agent (FL-1) | 5.0 g | 8.5 g |
| Triisopropanolamine | 8.8 g | 8.8 g |
| Sodium p-Toluenesulfonate | 20.0 g | 20.0 g |
| Ethylenediaminetetraacetic Acid | 4.0 g | 4.0 g |
| Sodium Sulfite | 0.10 g | 0.50 g |
| Potassium Chloride | 10.0 g | — |

-continued

| | Tank Solution | Replenisher |
|---|---|---|
| Sodium 4,5-Dihydroxybenzene-1,3-disulfonate | 0.50 g | 0.50 g |
| Disodium-N,N-bis(sulfonato-ethyl) hydroxylamine | 8.5 g | 14.5 g |
| 4-Amino-3-methyl-N-ethyl-N-(β-methanesulfonamidoethyl)-aniline.3/2 Sulfate.Monohydrate | 10.0 g | 22.0 g |
| Potassium Carbonate | 26.3 g | 26.3 g |
| Water to make | 1,000 ml | 1,000 ml |
| pH (25° C., adjusted with sulfuric acid and KOH) | 10.35 | 12.6 |
| Blixing Solution | | |
| Water | 800 ml | 800 ml |
| Ammonium Thiosulfate (750 g/liter) | 107 ml | 214 ml |
| Succinic Acid | 29.5 g | 59.0 g |
| Ammonium Ethylenediamine-tetraacetato Ferrate (III) | 47.0 g | 94.0 g |
| Ethylenediaminetetraacetic Acid | 1.4 g | 2.8 g |
| Nitric Acid (67%) | 17.5 g | 35.0 g |
| Imidazole | 14.6 g | 29.2 g |
| Ammonium Sulfite | 16.0 g | 32.0 g |
| Potassium Metabisulfite | 23.1 g | 46.2 g |
| Water to make | 1,000 ml | 1,000 ml |
| pH (25° C., adjusted with nitric acid and aqueous ammonia) | 6.00 | 6.00 |
| Rinsing Solution | | |
| Sodium Chlorinated Isocyanurate | 0.02 g | 0.02 g |
| Deionized water (electric conductivity: 5 μs/cm or less) | 1,000 ml | 1,000 ml |
| pH (25° C.) | 6.5 | 6.5 |

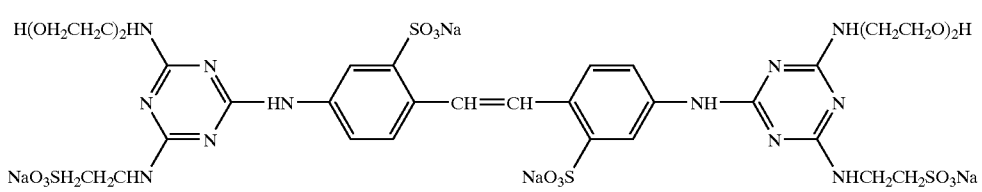

FL-1

EXAMPLE 5

An image was formed by laser scanning exposure with Sample Nos. 401 to 405.

Three types of laser beams were used as laser light sources, i.e., YAG solid state laser (oscillation wavelength: 946 nm) using a semiconductor laser GaAlAs (oscillation wavelength: 808.5 nm) as the excitation light source the wavelength of which was converted with SHG crystal of $LiNbO_3$ having reversal domain structure to 473 nm, $YVO_4$ solid state laser (oscillation wavelength: 1,064 nm) using a semiconductor laser GaAlAs (oscillation wavelength: 808.7 nm) as the excitation light source the wavelength of which was converted with SHG crystal of $LiNbO_3$ having reversal domain structure to 532 nm, and AlGaInP (oscillation wavelength: about 680 nm, manufactured by Matsushita Densan Co., Ltd., Type No. LN9R20). Each of three color laser beams was made to be able to transfer vertically to scanning direction by a polygonal mirror and successively scanning expose the sample. For restraining the fluctuation of light amount due to the change of temperature, the temperature of semiconductor laser was maintained constant using Peltier element. The effective beam diameter is 80 μm, the scanning pitch was 42.3 μm (600 dpi) and the average exposure time per one pixel was $1.7\times10^{-7}$ seconds.

After exposure, the samples were processed according to color development process B. Sample Nos. 402 and 405 of the present invention showed high sensitivity similarly to the results of high intensity exposure in Example 2, which proved that the present invention was also applicable to the image formation using laser scanning exposure.

Effect of the Invention

According to the present invention, a silver halide photographic emulsion which is low in generation of fog notwithstanding high sensitivity, excellent in a reciprocity law characteristic at high intensity illuminance, and low in fluctuations in sensitivity and gradation due to the time variation after exposure until processing can be obtained.

While the invention has been described in detail and with reference to specific examples thereof, it will be apparent to one skilled in the art that various changes and modifications can be made therein without departing from the spirit and scope thereof.

What is claimed is:

1. A silver halide photographic emulsion comprising silver chloroiodide grains or silver chloroiodobromide grains, having 90 mol % or more of a silver chloride content, wherein said silver chloroiodide grains or silver chloroiodobromide grains have a layer having a silver iodide content decreasing in the depth direction from the grain surface.

2. The silver halide photographic emulsion as claimed in claim 1, wherein the silver halide photographic emulsion is produced by a method of finishing the introduction of the iodide ion before 98% of the volume of said grains are formed.

3. The silver halide photographic emulsion as claimed in claim 1, wherein the introduction of the iodide ion is carried out by using silver halide fine grains containing silver iodide.

4. The silver halide photographic emulsion as claimed in claim 1, wherein the introduction of the iodide ion is carried out by using silver halide fine grains containing silver iodide which are formed by providing and mixing an aqueous solution of a water-soluble silver salt and an aqueous solution of a water-soluble halide compound containing the iodide ion in a mixing vessel which is provided separately from a reaction vessel in which a nucleation and/or grain growth of the silver halide grain is carried out.

5. The silver halide photographic emulsion as claimed in claim 3, wherein said silver halide fine grains have a grain size of 0.06 μm or less.

6. The silver halide photographic emulsion as claimed in claim 1, wherein the main planes of said silver chloroiodide grains or silver chloroiodobromide grains comprise {100} faces.

7. The silver halide photographic emulsion as claimed in claim 1, wherein said silver chloroiodide grains or silver chloroiodobromide grains contain one or more transition metal complexes.

8. The silver halide photographic emulsion as claimed in claim 1, wherein the content of the iodide ion is 0.1 mol % or more of the total silver amount of the entire emulsion grains.

9. The silver halide photographic emulsion as claimed in claim 1, wherein the content of the iodide ion is 0.06 mol % or more of the total silver amount of the entire emulsion grains and the silver halide emulsion is spectrally sensitized with a trimethine cyanine dye.

10. The silver halide photographic emulsion as claimed in claim 7, wherein the content of the iodide ion is 0.06 mol % or more of the total silver amount of the entire emulsion grains and the central metal of at least one kind of the transition metal complex is ruthenium or osmium.

11. A silver halide color photographic material comprising a support having provided thereon at least one blue-sensitive silver halide emulsion layer, at least one green-sensitive silver halide emulsion layer and at least one red-sensitive silver halide emulsion layer, wherein at least one of said blue-sensitive silver halide emulsion layer, green-sensitive silver halide emulsion layer and red-sensitive silver halide emulsion layer contains the silver halide emulsion described in claim 1.

* * * * *